US008159404B2

(12) United States Patent
Wakui

(10) Patent No.: US 8,159,404 B2
(45) Date of Patent: Apr. 17, 2012

(54) MULTIPLE FREQUENCY ANTENNA

(75) Inventor: Masashi Wakui, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 397 days.

(21) Appl. No.: 12/296,108

(22) PCT Filed: Oct. 11, 2007

(86) PCT No.: PCT/JP2007/069816

§ 371 (c)(1),
(2), (4) Date: Oct. 5, 2008

(87) PCT Pub. No.: WO2008/072415

PCT Pub. Date: Jun. 19, 2008

(65) Prior Publication Data

US 2009/0284441 A1 Nov. 19, 2009

(30) Foreign Application Priority Data

Dec. 12, 2006 (JP) ..... 2006-334104
May 1, 2007 (JP) ..... 2007-120542

(51) Int. Cl.

| | |
|---|---|
| ***H01Q 1/32*** | (2006.01) |
| ***H01Q 1/36*** | (2006.01) |
| ***H01Q 1/00*** | (2006.01) |
| ***H01Q 21/00*** | (2006.01) |
| ***H01Q 9/30*** | (2006.01) |

(52) U.S. Cl. ..... 343/715; 343/725; 343/895; 343/893; 343/826; 343/831; 343/728; 343/729

(58) Field of Classification Search ..... 343/715, 343/725, 895, 893, 826, 828, 831, 728, 729
See application file for complete search history.

(56) References Cited

U.S. PATENT DOCUMENTS 4,800,395 A 1/1989 Balzano et al.
(Continued)

FOREIGN PATENT DOCUMENTS

JP 03-9375 8/1991
(Continued)

OTHER PUBLICATIONS

Helical Antenna, Antenna Theory Analysis and Design, 3rd Edition, Constantine A. Balanis, 2005, pp. 566 to 576.*

*Primary Examiner* — Jacob Y Choi
*Assistant Examiner* — Graham Smith
(74) *Attorney, Agent, or Firm* — Oliff & Berridge, PLC

(57) ABSTRACT

A helical element, which is operated in the frequency band of FM broadcast, is wound around the outer periphery of a rod-shaped support member 10. A line-shaped element 12, which is operated in the frequency band of terrestrial digital television broadcast, is disposed in a first groove 10*a* of a predetermined length formed on the outer periphery of the support member 10 from the lower end thereof. With this arrangement, a multi-frequency antenna 1, which is operated in the frequency band of FM broadcast and the frequency band of terrestrial digital television broadcast, can be arranged, and the entire length L of the helical element can be reduced and it can be operated in a plurality of frequency bands with the effect of the line-shaped element 12.

10 Claims, 20 Drawing Sheets

U.S. PATENT DOCUMENTS

| | | | | |
|---|---|---|---|---|
| 5,446,469 | A * | 8/1995 | Makino | 343/702 |
| 6,107,970 | A * | 8/2000 | Holshouser et al. | 343/702 |
| 6,147,647 | A * | 11/2000 | Tassoudji et al. | 343/700 MS |
| 6,388,625 | B1 * | 5/2002 | Fukushima et al. | 343/702 |
| 6,559,811 | B1 * | 5/2003 | Pulimi et al. | 343/895 |
| 2006/0050009 | A1 * | 3/2006 | Ho et al. | 343/895 |

FOREIGN PATENT DOCUMENTS

| | | |
|---|---|---|
| JP | 11-068447 | 3/1999 |
| JP | 2000-295017 | 10/2000 |
| JP | A-2001-024424 | 1/2001 |
| JP | 2003-037426 | 2/2003 |

* cited by examiner

PORTION A ENLARGED

MULTIPLE FREQUENCY ANTENNA

This application is the U.S. National Phase under 35 U.S.C. §371 of International Application PCT Patent Application No. PCT/JP2007/069816, filed on Oct. 11, 2007, which claims priority to Japanese Patent Application No. 2007-120542, filed on May 1, 2007 and Japanese Patent Application No. 2006-334104, filed on Dec. 12. 2006; the contents of which are all herein incorporated by this reference in their entireties. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

TECHNICAL FIELD

The present invention relates to a multi-frequency antenna preferably mounted on vehicles capable of receiving FM broadcasts and terrestrial digital broadcasts.

BACKGROUND ART

Prior antenna devices attached to vehicles are ordinarily arranged as antenna devices which can receive AM broadcasts and FM broadcasts. As these antenna devices, there is known a vehicle-mounted antenna device arranged as a helical antenna having an antenna rod portion around which a helical element is helically wound.

FIG. 29 is a perspective view showing an example of an arrangement of the antenna device. In the antenna device 100 shown in FIG. 29, a helical element 111 is wound around the outer periphery of a rod-shaped insulation support member 110 at pitches p. A metal element fitting 113 is fitted with the lower end of the support member 110. The lower portion of the element fitting 113 is arranged as an attachment portion 114 for fixing the antenna device 100 to an antenna case attached to a roof and the like of a vehicle, and a male screw, for example, is formed on the attachment portion 114. Further, although not shown, the portion from the extreme of the support member 110, around which the helical element 111 is wound, to the element fitting 113 is molded with resin.

FIG. 30 shows the frequency characteristics of a voltage standing wave ratio (VSWR) in the frequency band of FM broadcast when the antenna device 100, which is composed of the support member 110, around which the helical element 111 is wounded, having a diameter $\phi$ of 6.8 mm, with pitches p of 1.48 mm, and a length L of 154 mm, is attached to the antenna case. Note that the length L1 of the element fitting 113 is set to about 22.5 mm. Referring to the frequency characteristics shown in FIG. 30, it can be seen that the antenna device 100 approximately resonates with 83 MHz which is the center frequency of FM broadcast. Since the frequency band of FM broadcast in Japan is set from 76 MHz to 90 MHz, it can be found that the antenna device 100 shown in FIG. 29 is approximately operated in the frequency band of FM broadcast. Incidentally, it is recently desired to receive terrestrial digital television broadcast also by vehicles. The frequency band of the terrestrial digital televisions employs an UHF band from 470 MHz to 710 MHz. FIG. 31 shows the frequency characteristics of the UHF band when the antenna device 100 shown in FIG. 29 is attached to the antenna case. Referring to FIG. 31, it can be found that the antenna device 100 does not operate in the UHF band and cannot receive terrestrial digital television broadcast, although this is a matter of course because the antenna device 100 is arranged to receive FM broadcast.

FIG. 32 shows an arrangement example of a prior multi-frequency antenna which is operated in a plurality of frequency bands.

In the multi-frequency helical antenna 200 shown in FIG. 32, the length of a passive coil portion 216, in which the number of windings is increased, is adjusted so that operation frequency band thereof is set to a 800 MHz band in a mobile phone network, and the length of a second passive coil portion 219, in which the number of windings is slightly reduced, is adjusted so that the operation frequency band thereof is set to the vicinity of the 800 MHz band in the mobile phone network. With this arrangement, a sufficiently wide frequency band can be secured even in the low frequency band of the 800 MHz. Further, when the length of an exciter coil portion 217, in which the number of windings is reduced, is adjusted so that the operation frequency band thereof is set to a 1.5 GHz band in the mobile phone network, the multi-frequency helical antenna 200 can be operated in the 800 MHz band and the 1.5 GHz band in the mobile phone network. Note that the passive coil portion 216 and the second passive coil portion 219 are excited by the exciter coil portion 217.

[Patent Document 1] Japanese Publication Unexamined Patent Application No. 2000-295017

[Patent Document 2] Japanese Publication Unexamined Patent Application No. 2003-37426

DISCLOSURE OF THE INVENTION

Problem That the Invention is Intended to Solve

The antenna device 100 has a problem in that it cannot be operated in a plurality of frequency bands. To cope with the above problem, it is considered to apply a multi-frequency technology for operating the multi-frequency helical antenna 200 in a plurality of frequency bands so that the antenna device 100 is operated in the plurality of frequency bands. That is, a passive helical element is further disposed between the pitches of the helical element 111. With this arrangement, the antenna device 100 can be arranged as a multi-frequency antenna which is operated in the plurality of frequency bands. However, since the passive helical element must be further disposed between the pitches of the helical element 111, it is necessary to increase the pitches of the helical element 111. As a result, since the length L of the helical element 111 is increased, the antenna device is disadvantageous in the design and handling thereof.

Accordingly, an object of the present invention is to provide a multi-frequency antenna the length of which can be reduced as far as possible even when it is operated in a plurality of frequency bands.

Means for Solving the Problem

To achieve the above object, the most important feature of the present invention is to provide a helical element, which is wound around the outer periphery of a support member and operated in a first frequency band, and a line-shaped element which is disposed in a groove portion formed on the outer periphery of the support member or in an accommodation hole formed in the support member and operated in a second frequency band.

Effect of the Invention

According to the present invention, an antenna is provided with helical element, which is wound around the outer periphery of the support member and operated in the first frequency band, and the line-shaped element which is disposed in the groove portion formed on the outer periphery of the support member or in the accommodation hole formed in the support member and operated in the second frequency band, thereby the antenna can be arranged as a multi-frequency antenna. In this case, since what is operated in the second frequency band is the line-shaped element disposed in the groove portion or in the accommodation hole, the pitches of the helical element are not necessary to be increased and thus the overall length of the multi-frequency antenna can be. Further, the overall length of the multi-frequency antenna can be reduced with the effect of the helical element.

BRIEF DESCRIPTION OF THE DRAWINGS

FIG. 6 is a block diagram showing an arrangement of a receiving system when the multi-frequency antenna of the first embodiment according to the present invention is mounted on a vehicle and the like.

FIG. 18(*b*) is a partially enlarged view of the line-shaped element of the multi-frequency antenna of the third embodiment according to the present invention.

BEST MODE FOR CARRYING OUT THE INVENTION

Figure 1:
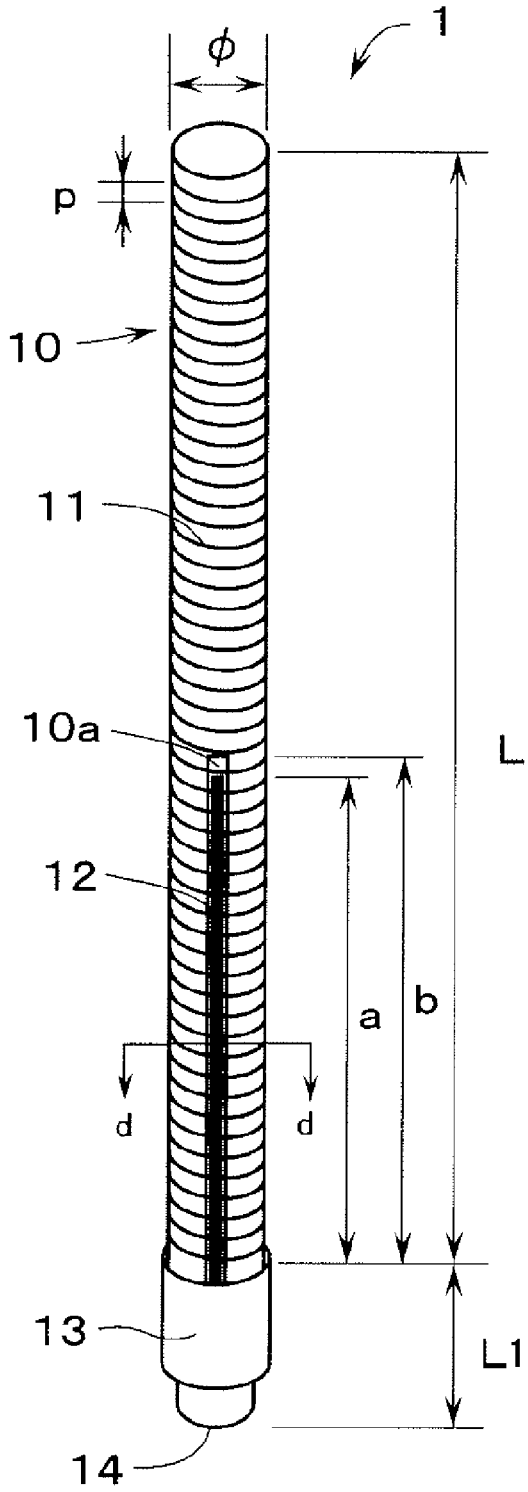
FIG. 1 is a perspective view showing an arrangement of a multi-frequency antenna of a first embodiment according to the present invention.
Figure 2:
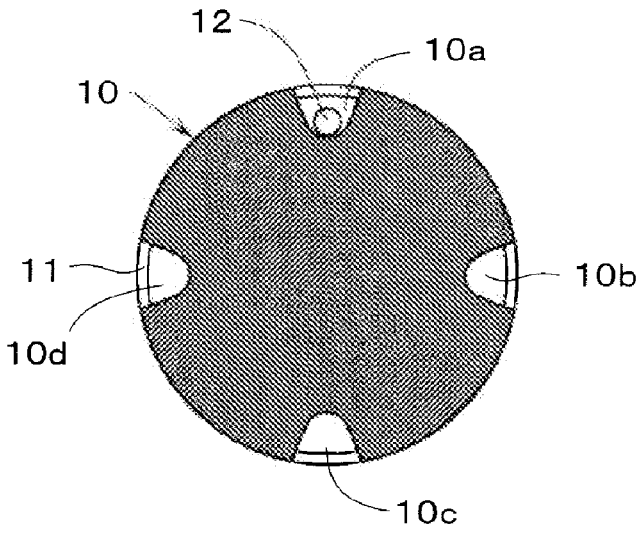
FIG. 2 is a sectional view showing the arrangement of the multi-frequency antenna of the first embodiment according to the present invention taken along the line d-d of FIG. 1.

FIG. 1 is a perspective view showing an arrangement of a multi-frequency antenna of a first embodiment according to the present invention, and FIG. 2 is a sectional view showing the arrangement of the multi-frequency antenna of the first embodiment taken along the line d-d of FIG. 1.

The multi-frequency antenna 1 shown in these drawings is composed of a rod-shaped insulation support member 10 which has an approximately circular cross section and a helical element 11 wound around the outer periphery thereof at pitches p. A metal element fitting 13 is fitted with the lower end of the support member 10 and electrically connected to the lower end of the helical element 11. The lower portion of the element fitting 13 is arranged as an attachment portion 14 having a reduced diameter to fix the multi-frequency antenna 1 to an antenna case and the like, and a male screw is formed on the attachment portion 14 so that it is threaded into the antenna case attached to, for example, a roof of a vehicle. The support member 10 is molded with resin and has flexibility, and a helical groove is formed around the outer periphery thereof. The helical element 11 having the pitches p is formed by winding a conductor in the helical groove. Further, although not shown, a portion from the extreme end of the support member 10, around which the helical element 11 is wound, to the element fitting 13 is molded with resin so as to cover the helical element 11.

Further, four groove portions, that are, a first groove portion 10*a*, a second groove portion 10*b*, a third groove portion 10*c*, and a fourth groove portion 10*d* are formed from the lower end of the support member 10 upward approximately in parallel with the central axis of the support member 10. The first groove portion 10*a* to the fourth groove portion 10*d* have approximately the same shape, which is a taper shape made narrower toward the extreme ends thereof, and the extreme ends of the groove portions are formed in a semicircular shape. A line-shaped element 12, which has a length slightly shorter than the length b of the first groove portion 10*a*, is disposed in the first groove portion 10*a* with an interval defined between it and the helical element 11. In this case, the line-shaped element 12 is disposed in the semicircular portion of the first groove portion 10*a* at the extreme end thereof so that at least about 1 mm of the interval can be secured between the line-shaped element 12 and the helical element 11. The line-shaped element 12 is covered with an insulation film of polyurethane and the like, and thus even if it comes into contact with the helical element 11 spaced apart therefrom, it is insulated therefrom in direct current. The lower end of the line-shaped element 12 is electrically connected to the element fitting 13, and thus power is supplied to the helical element 11 and the line-shaped element 12 from the element fitting 13. Note that the first groove portion 10*a* to the fourth groove portion 10*d* are formed at equal intervals so that when bending stress is applied to the support member 10, it is uniformly dispersed and thus the support member 10 is prevented from being broken by the bending stress even with the grooves formed.

Figure 3:
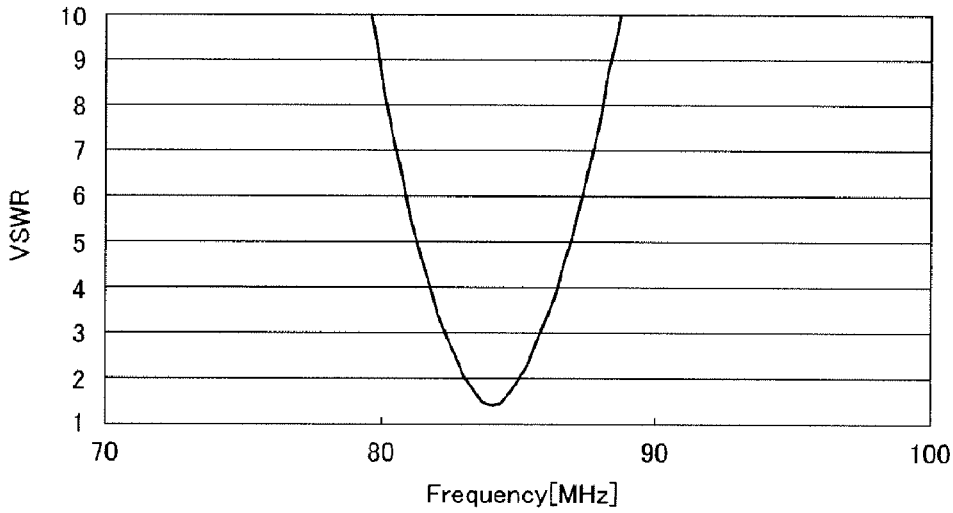
FIG. 3 is a view showing the frequency characteristics of a VSWR in the frequency band of FM broadcast of the multi-frequency antenna of the first embodiment according to the present invention.
Figure 4:
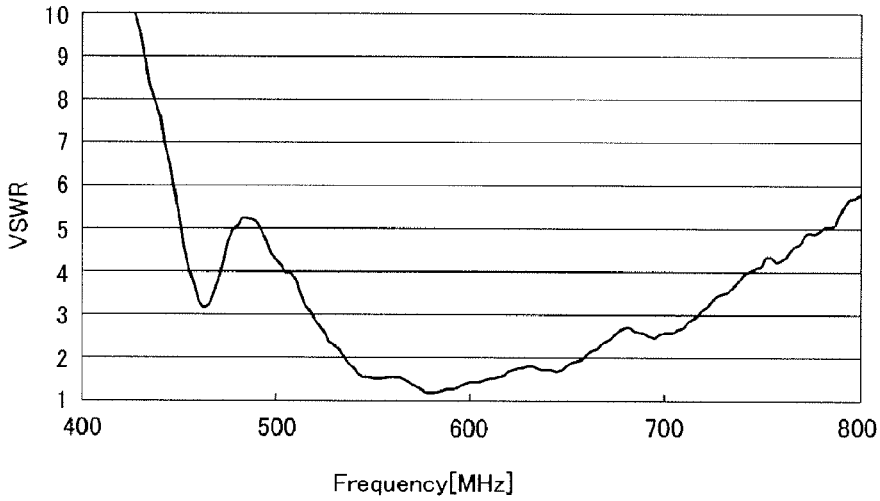
FIG. 4 is a view showing the frequency characteristics of a VSWR in the frequency band of terrestrial digital television broadcast of the multi-frequency antenna of the first embodiment according to the present invention.

Here, the helical element 11 is made to have a length L, which allows the helical element 11 to resonate with the frequency band of FM broadcast, and the line-shaped element 12 is made to have a length, which allows the line-shaped element 12 to resonate with the frequency band of terrestrial digital television broadcast. In this case, the diameter ϕ of the helical element 11 wound around the support member 10 is set to about 6.8 mm, the pitches p thereof are set to about 1.76 mm, the length L thereof is set to about 139 mm, and the length a of the line-shaped element 12 is set to about 80 mm. Note that the length b of the first groove portion 10*a* is set to about 85 mm, and the length L1 of the element fitting 13 is set to about 22.5 mm. Further, the interval between the helical element 11 and the line-shaped element 12 is set at least about 1 mm. FIGS. 3 and 4 show the frequency characteristics of a voltage standing wave ratio (VSWR) when the multi-frequency antenna 1 having the above dimensions is attached to the antenna case.

The frequency characteristics shown in FIG. 3 are the frequency characteristics of a VSWR in the frequency band of FM broadcast of the multi-frequency antenna 1. Referring to FIG. 3, it can be seen that the multi-frequency antenna 1 is approximately resonated with 83 MHz which is the center frequency of FM broadcast, which means that it is approximately operated in the frequency band of FM broadcast.

Further, the frequency characteristics shown in FIG. 4 is the frequency characteristics of a VSWR in the frequency band of the terrestrial digital television broadcast in the multi-frequency antenna 1 of the first embodiment according to the present invention. Referring to FIG. 4, it can be seen that the frequency characteristics are broad frequency characteristics, in which the multi-frequency antenna 1 resonates with the vicinity of 590 MHz that is the center frequency of terrestrial digital television broadcast, which means that the multi-frequency antenna 1 is approximately operated in the 470 MHz to 710 MHz frequency band of terrestrial digital television broadcast.

Figure 29:
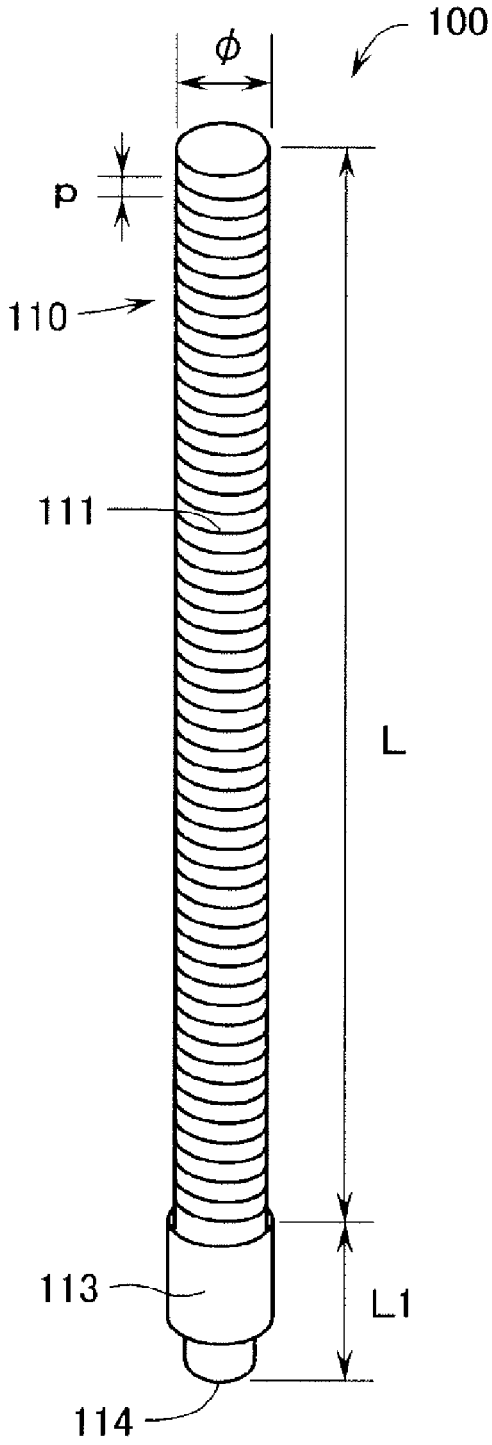
FIG. 29 Prior art
FIG. 29 is a perspective view showing an example of an arrangement of a prior antenna device.
Figure 30:
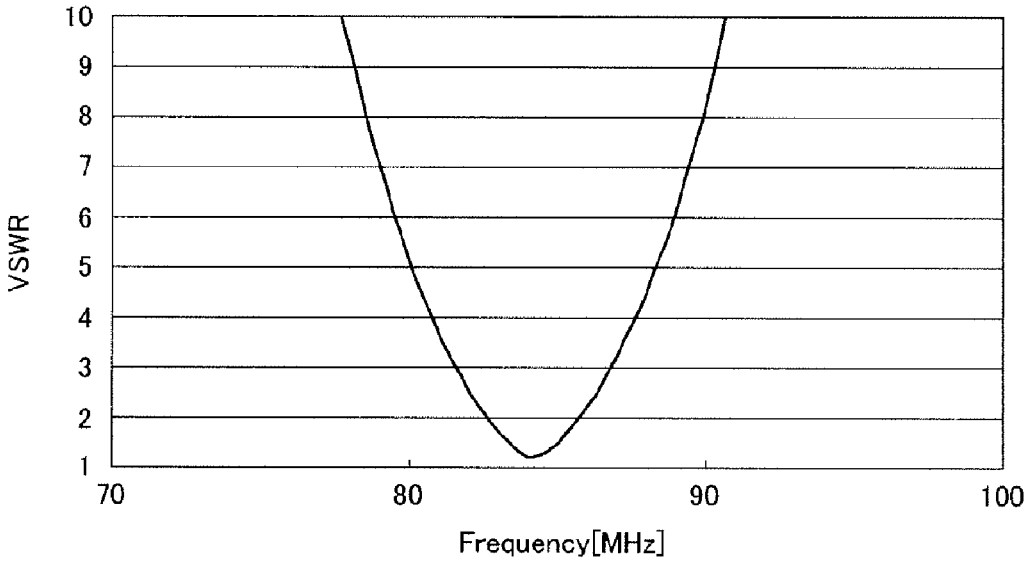
FIG. 30 is a view showing the frequency characteristics of a VSWR in the frequency band of FM broadcast of the prior antenna device.
Figure 31:
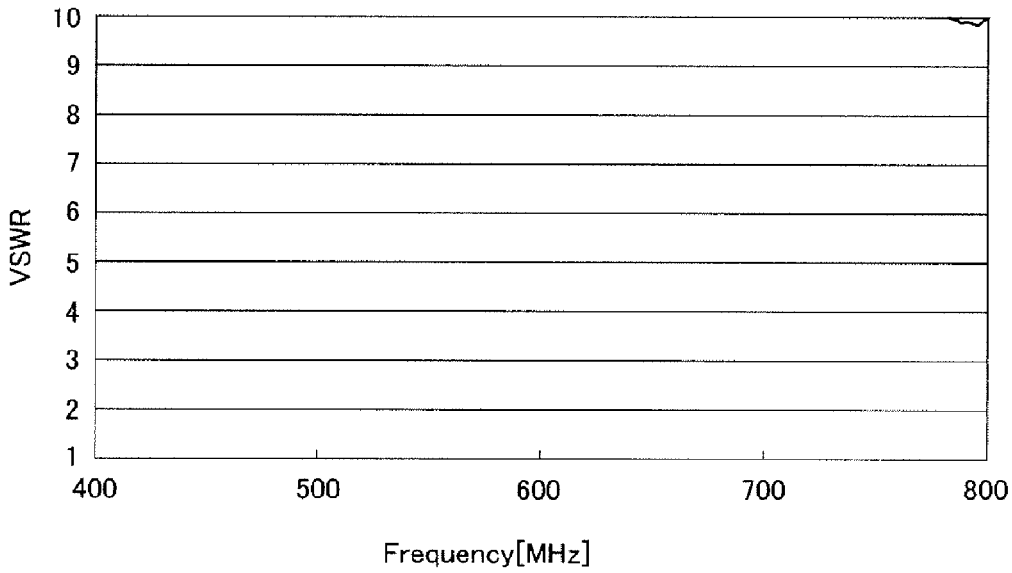
FIG. 31 is a view showing the frequency characteristics of a VSWR in the UHF band of the prior antenna device.
Figure 32:
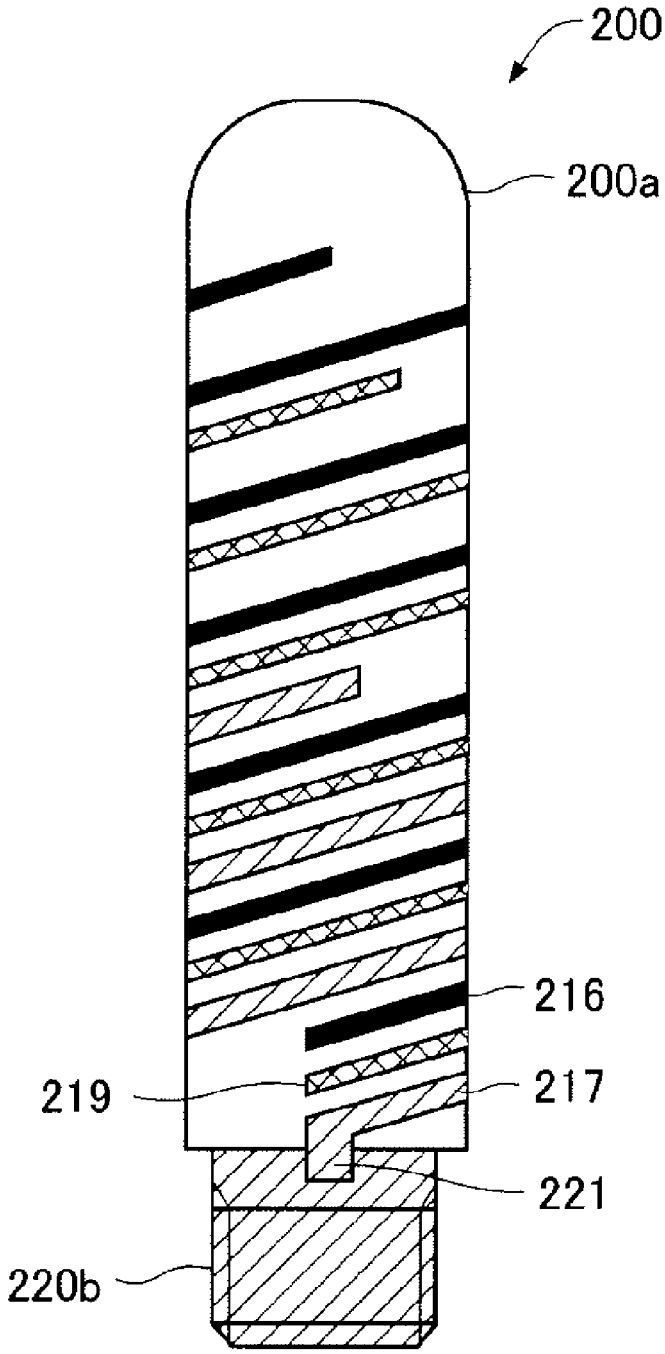
FIG. 32 Prior art
FIG. 32 is a view showing an example of an arrangement of a prior multi-frequency antenna operated in a plurality of frequency bands.

Note that, in the prior antenna device 100 shown in FIG. 29 and having the helical element, when the pitches p of the helical element are set to about 1.48 mm and the length L thereof is set to 154 mm, the prior antenna device 100 approximately resonates with 83 MHz which is the center frequency of FM broadcast. In contrast, the multi-frequency antenna 1 according to the present invention approximately resonates with 83 MHz, which is the center frequency of FM broadcast, even with the length L shortened to 139 mm regardless that the pitches p are increased to about 1.76 mm.

Figure 5:
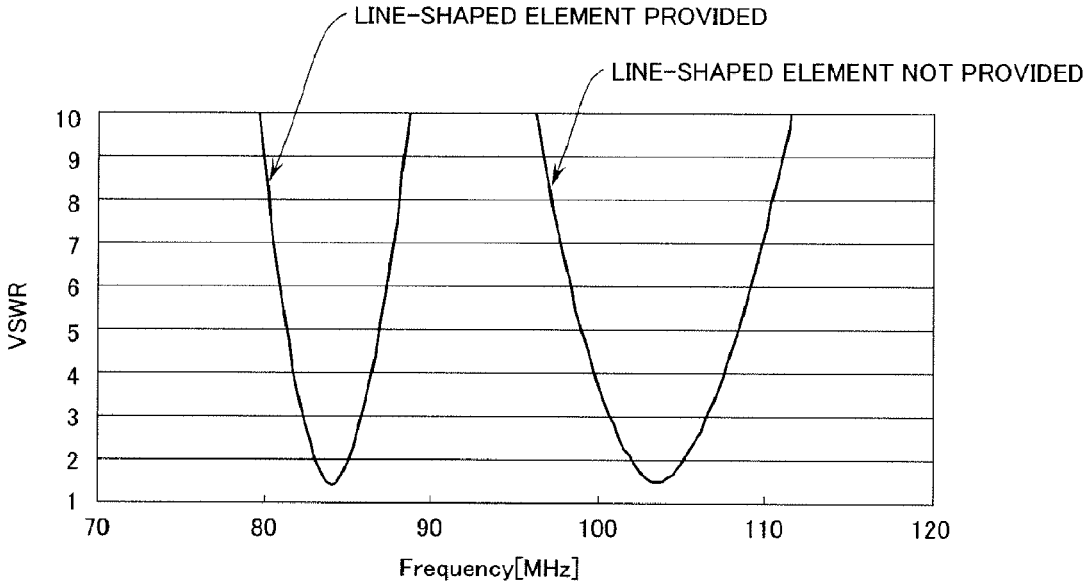
FIG. 5 is a view showing the frequency characteristics of a VSWR of a helical element when a line-shaped element of the multi-frequency antenna of the first embodiment according to the present invention is provided and when it is not provided.

It is considered that this is because the electric length of the helical element 11 is equivalently increased with the effect of the line-shaped element 12. FIG. 5 shows the frequency characteristics of a VSWR in the frequency band of FM broadcast in the helical element 11 having the above dimensions when the line-shaped element 12 is provided and when it is not provided. Referring to FIG. 5, when the line-shaped element 12 is not provided, it can be seen the helical element 11 resonates with about 103 MHz, which means that it cannot cover the frequency band of FM broadcast. However, it can be seen that when the line-shaped element 12 is provided, the helical element 11 resonates with about 83 MHz, which means that it can cover the frequency band of FM broadcast with the effect of the line-shaped element 12. As described above, the multi-frequency antenna 1 according to the present invention can be low-profiled even being allowed to operate in a plurality of frequency bands. Note that by using the helical element 11 as a voltage receiving device in the frequency band of AM broadcast, the helical element 11 can be also used as an antenna for receiving AM broadcast. With this arrangement, the multi-frequency antenna 1 of the first embodiment according to the present invention can be arranged as a multi-frequency antenna capable of receiving AM/FM broadcast and terrestrial digital television broadcast.

Figure 6:
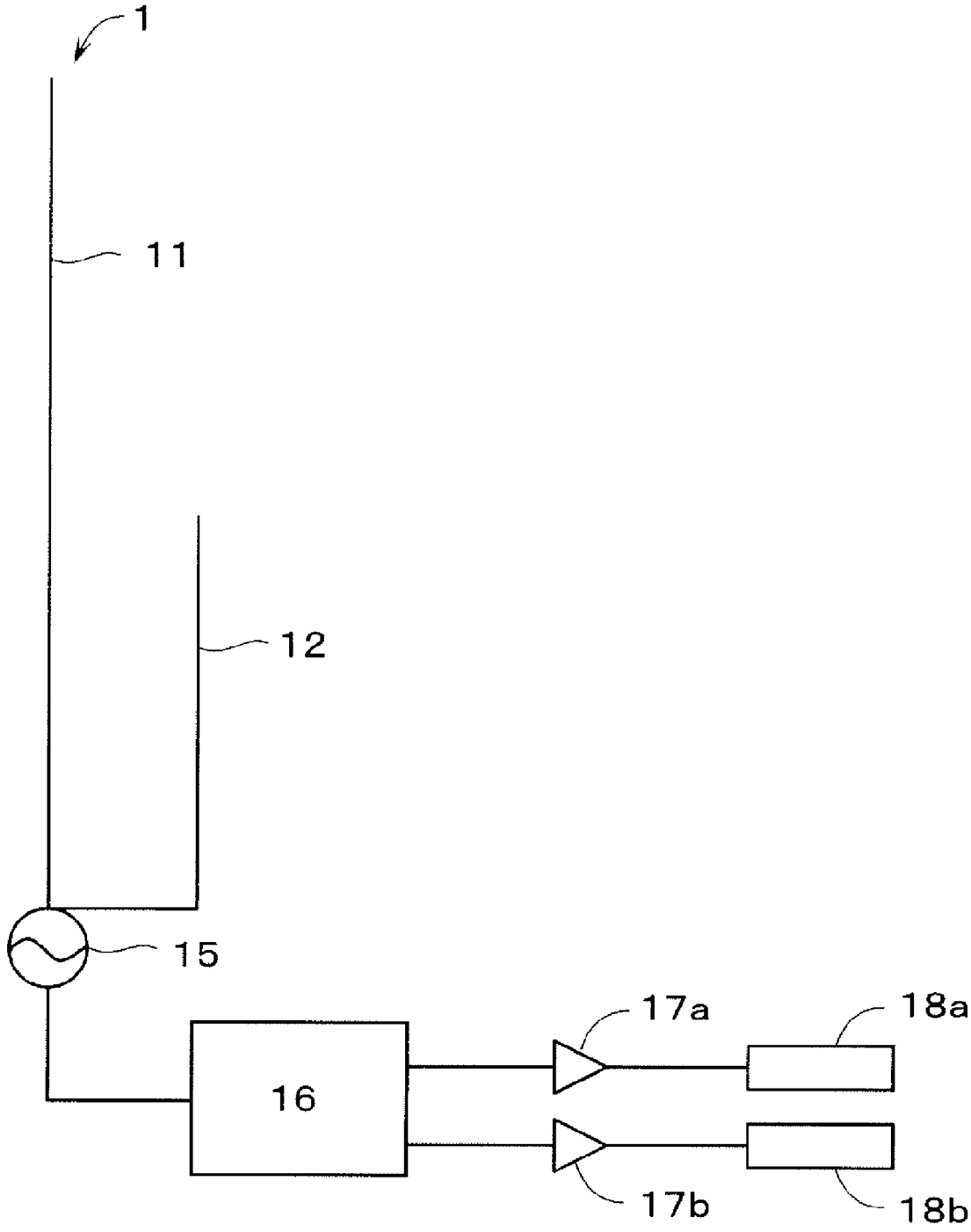

FIG. 6 is a block diagram showing an arrangement of a receiving system when the multi-frequency antenna 1 of the first embodiment according to the present invention described above is mounted on the vehicle and the like.

As shown in FIG. 6, the multi-frequency antenna 1 includes the helical element 11 and the line-shaped element 12. The lower ends of the helical element 11 and the line-shaped element are connected so that power from the same power supply unit 15 is supplied. A receiving signal derived from the power supply unit 15 branches into an FM broadcast receiving signal and a terrestrial digital television broadcast receiving signal by a branching filter 16. The branched receiving signal of FM broadcast is amplified by an FM amplifier 17*a* and supplied to a radio receiver 18*a* having an FM broadcast receiving unit. Further, the branched receiving signal of terrestrial digital television broadcast is amplified by a terrestrial digital television amplifier 17*b* and supplied to a terrestrial digital television tuner 18*b*. As a result, at least the FM broadcast and the terrestrial digital television broadcast can be received only by mounting the multi-frequency antenna 1.

Figure 7:
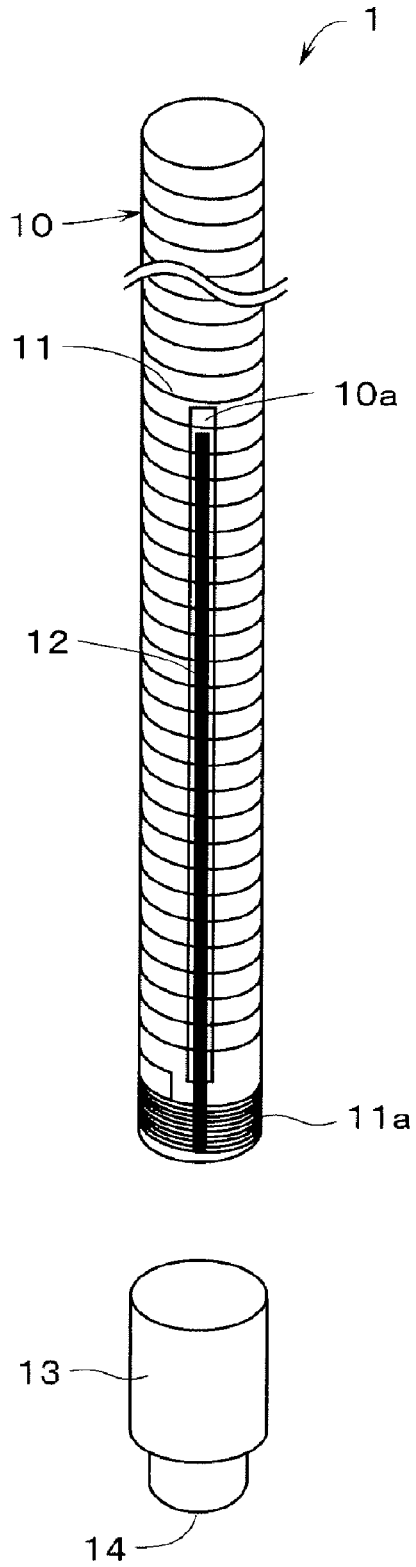
FIG. 7 is an enlarged perspective view showing an arrangement in which an element fitting is fitted with the lower portion of a support member of the multi-frequency antenna of the first embodiment according to the present invention.
Figure 8:
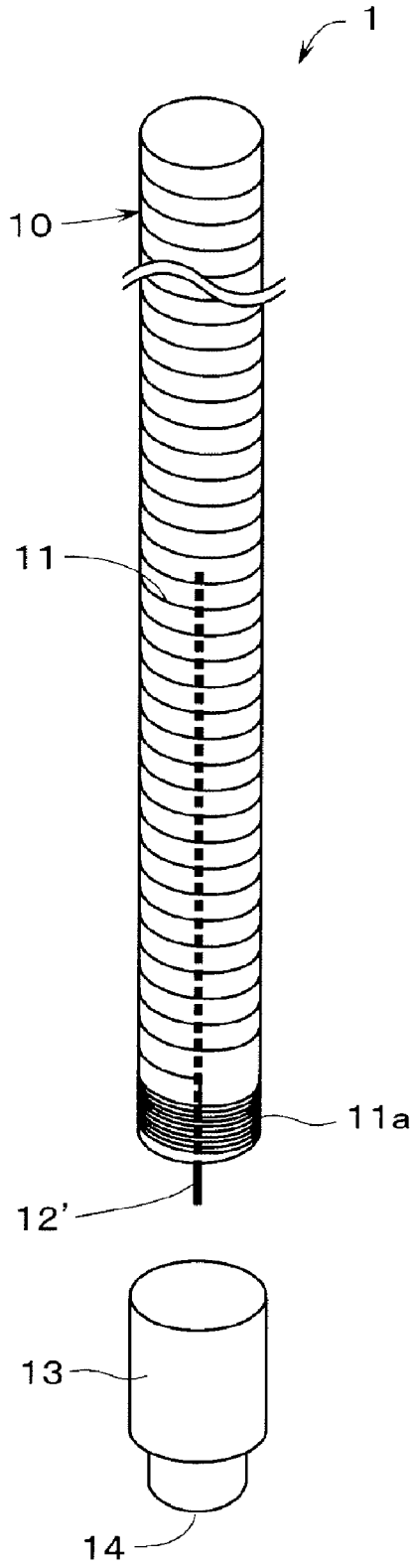
FIG. 8 is a perspective view showing an arrangement to be compared with the arrangement in which the element fitting is fitted with the lower portion of the support member of the multi-frequency antenna of the first embodiment according to the present invention.

Further, in the multi-frequency antenna 1 of the first embodiment according to the present invention, the element fitting 13 is fitted with the lower portion of the support member 10 around which the helical element 11 is wound. FIG. 7 is an enlarged perspective view showing the fitting process. As shown in FIG. 7, the lower end of the helical element 11 is bent downward and connected to a connecting portion 11*a* in which it is densely wound around the lower end of the support member 10. Further, the lower end of the line-shaped element 12*a* is extended and the insulation film is removed only from the extended portion so as to be connected to the connecting portion 11*a*. In this state, the element fitting 13 is fitted with the lower end of the support member 10 so as to cover the connecting portion 11*a* and caulked. With this operation, the helical element 11 and the line-shaped element 12 are electrically connected to the element fitting 13. In this case, it is considered to accommodate a line-shaped element 12' in an accommodation hole formed along approximately the central axis of the support member 10 as shown in FIG. 8. However, when the line-shaped element 12' is accommodated in the accommodation hole formed along approximately the central axis of the support member 10 as shown in FIG. 8, it is difficult to securely connect the line-shaped element 12' to the element fitting 13 only by fitting the element fitting 13 with the lower end of the support member 10 and caulking it so as to cover the connecting portion 11*a*, although the helical element 11 is connected to the element fitting 13. Thus, another means is necessary to connect the line-shaped element 12' to the element fitting 13. As described above, the arrangement of the power supply unit can be simplified by the arrangement in which the line-shaped element 12 is disposed in the groove portion formed on the outer periphery of the support member 10. Further, when the accommodation hole for accommodating the line-shaped element 12' is formed along approximately the central axis of the support member 10, the support member 10 is formed in a pipe shape and made less flexible, thus the support member 10 is likely to be broken when bending stress is applied thereto.

Figure 9:
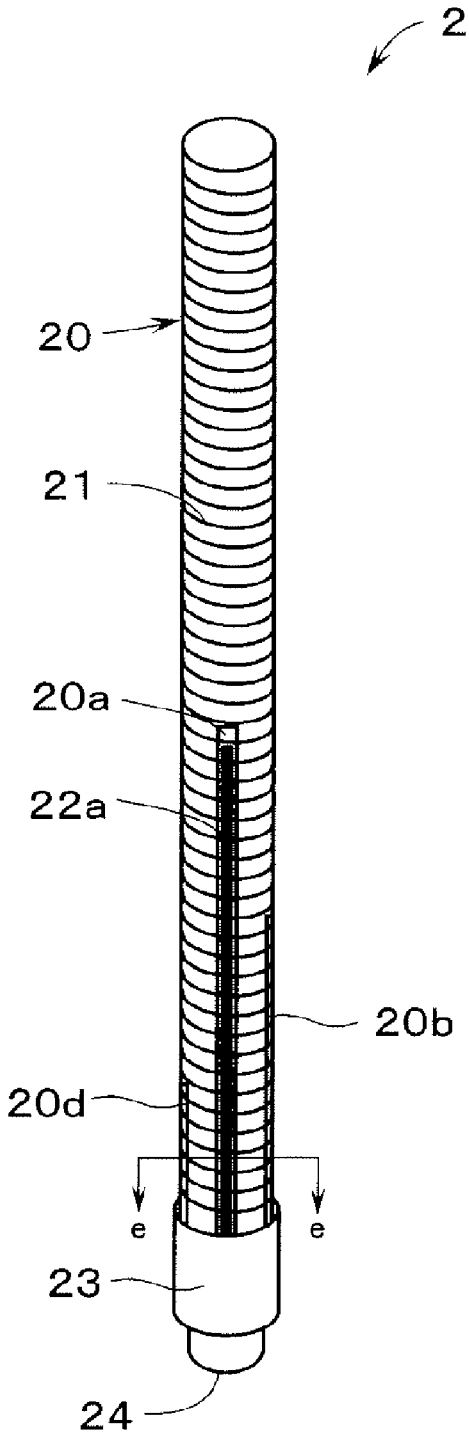
FIG. 9 is a perspective view showing an arrangement of a multi-frequency antenna of a second embodiment according to the present invention.
Figure 10:
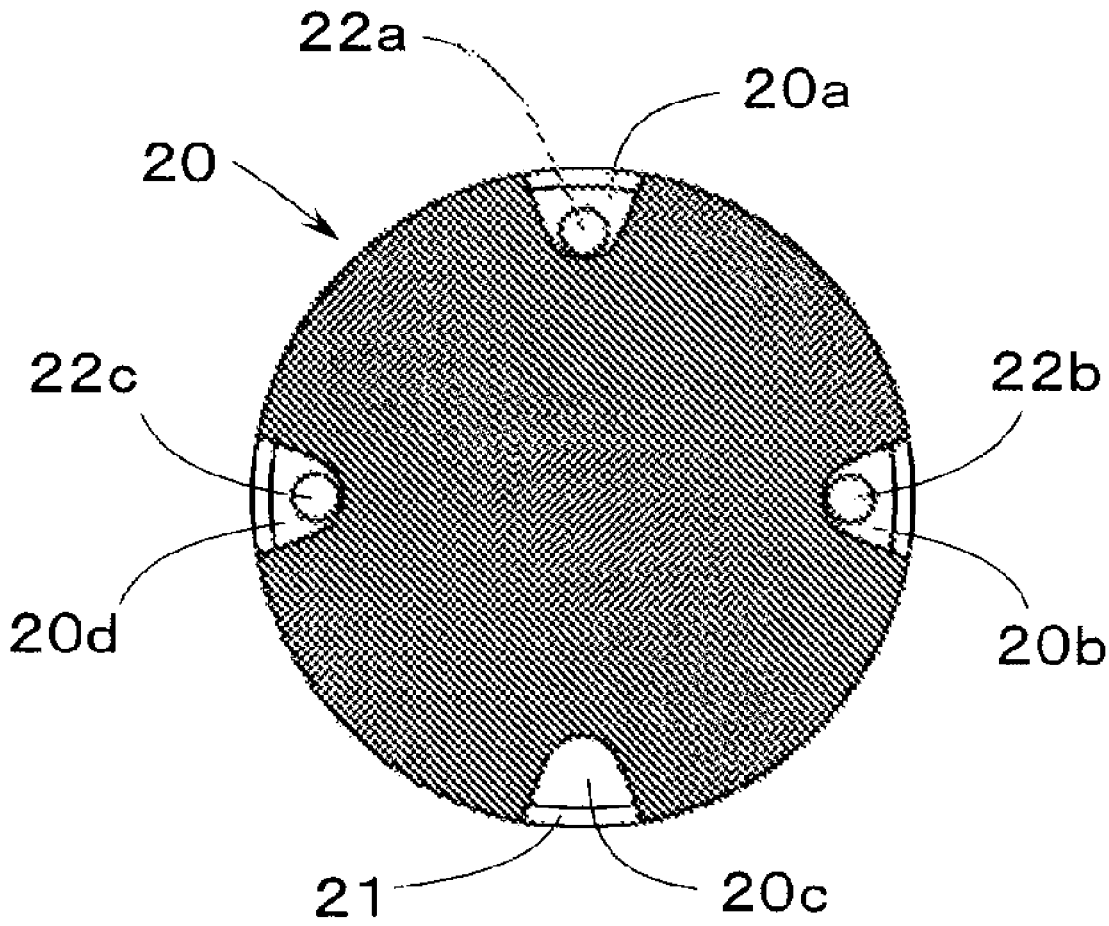
FIG. 10 is a sectional view showing the arrangement of the multi-frequency antenna of the second embodiment according to the present invention taken along the line e-e of FIG. 9.

FIG. 9 is a perspective view showing an arrangement of a multi-frequency antenna of a second embodiment according to the present invention, and FIG. 10 is a sectional view showing the arrangement of the multi-frequency antenna of the second embodiment taken along the line e-e of FIG. 9.

The multi-frequency antenna 2 shown in these drawings is composed of a rod-shaped insulation support member 20 which has an approximately circular cross section and a helical element 21 wound around the outer periphery thereof at predetermined pitches. A metal element fitting 23 is fitted with the lower end of the support member 20 and electrically connected to the lower end of the helical element 21. The lower portion of the element fitting 23 is arranged as an attachment portion 24 having a reduced diameter to fix the multi-frequency antenna 2 to an antenna case and the like, and a male screw is formed on the attachment portion 24 so that it is threaded into the an antenna case attached to, for example, a roof and the like of a vehicle. The support member 20 is molded with resin and has flexibility, and a helical groove is formed around the outer periphery thereof. The helical element 21 having the predetermined pitches is formed by winding a conductor in the helical groove. Although not shown, a portion from the extreme end of the support member 20, around which the helical element 21 is wound, to the element fitting 23, is molded with resin so as to cover the helical element 21.

Further, four groove portions having a predetermined length, that are, a first groove portion 20*a*, a second groove portion 20*b*, a third groove portion 20*c*, and a fourth groove portion 20*d* are formed from the lower end of the support member 20 upward approximately in parallel with the central axis thereof. The first groove portion 20*a* to the fourth groove portion 20*d* have approximately the same taper shape, which is a taper shape made narrower toward the extreme ends thereof, and the extreme ends of the groove portions are formed in a semicircular shape. Then, a line-shaped element 22*a* is disposed in the first groove portion 20*a*, a line-shaped element 22*b* is disposed in the second groove portion 20*b*, and a line-shaped element 22*d* is disposed in the fourth groove portion 20*d* with intervals between them and the helical element 21. In this case, the line-shaped elements 22*a*, 22*b*, 22*d* are disposed in the semicircular portions of the first groove portion 20*a*, the second grove portion 20*b*, and the fourth groove 20*d* at the extreme ends thereof so that at least about 1 mm of the interval can be secured between the line-shaped elements and the helical element 21. The line-shaped elements 22*a*, 22*b*, 22*d* are covered with an insulation film of polyurethane and the like, and thus even if they come into contact with the helical element 21 spaced apart therefrom, they are insulated therefrom in direct current. The lower ends of the line-shaped elements 22*a*, 22*b*, 22*d* are electrically connected to the element fitting 23, and thus power is supplied to the helical element 21 and the line-shaped elements 22*a*, 22*b*, 22*d* from the element fitting 23. Note that the first groove portion 20*a* to the fourth groove portion 20*d* are formed at equal intervals so that when bending stress is applied to the support member 20, it is uniformly dispersed and thus the support member 20 is prevented from being broken by the bending stress even with the grooves formed.

Here, the helical element 21 is made to have a length L, which allows the helical element 21 to resonate with the frequency band of FM broadcast, and the line-shaped element 22*a* is made to have a length, which allows the line-shaped element 22*a* to resonate with the frequency band of terrestrial digital television broadcast. Further, the line-shaped element 22*b* is made to have a length, which allows the line-shaped element 22*b* to resonate with frequency band of the 800 MHz mobile phone network, and the line-shaped element 22*d* is made to have a length, which allows the line-shaped element 22*d* to resonate with frequency band of the 1.8 GHz mobile phone network. With this arrangement, the multi-frequency antenna 2 of the second embodiment can be arranged as a multi-frequency antenna which is operated in the four frequency bands. However, the frequency bands in which the multi-frequency antenna 2 is operated are not limited to the above frequency bands except the frequency band of FM broadcast. That is, the multi-frequency antenna 2 can be operated in the frequency bands of terrestrial digital radio, the frequency bands of mobile phone network such as AMPS (Advanced Mobile Phone Service), GSM (Global System for Mobile Communications), DCS (Digital Communication System), PCS (Personal Communication Service), PDC (Personal Digital Cellular) and the like, and the frequency bands of a keyless system, a weather band, DAB (Digital Audio Broadcast) and the like. In this case, it is sufficient to set the lengths of the line-shaped elements 22*a*, 22*b*, 22*d* to the lengths corresponding to the frequency bands in which they are desired to be put into operation.

In the multi-frequency antenna 2 of the second embodiment, by using the helical element 21 as a voltage receiving device in the frequency band of AM broadcast, the helical element 21 can be also used as an antenna for receiving AM broadcast.

Note that the lower end of the helical element 21 is bent downward and connected to a connecting portion in which it is densely wound around the lower end of the support member 20 also in the multi-frequency antenna 2 of the second embodiment. Further, the lower ends of the line-shaped elements 22*a*, 22*b*, 22*d* are extended and the insulation film is removed only from the extended portions so as to connected to the connecting portion. In the state, the element fitting 23 is fitted with the lower end of the support member 20 so as to cover the connecting portion and caulked. With this arrangement, the helical element 21 and the line-shaped elements 22*a*, 22*b*, 22*d* are electrically connected to the element fitting 23.

Figure 11:
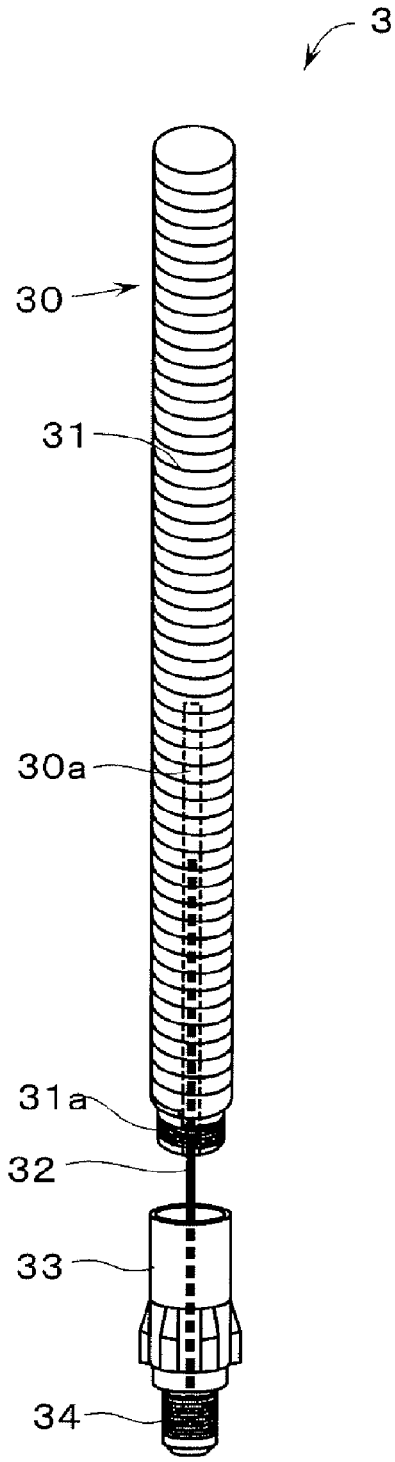
FIG. 11 is an exploded perspective view showing an arrangement of a multi-frequency antenna according to a third embodiment according to the present invention.
Figure 12:
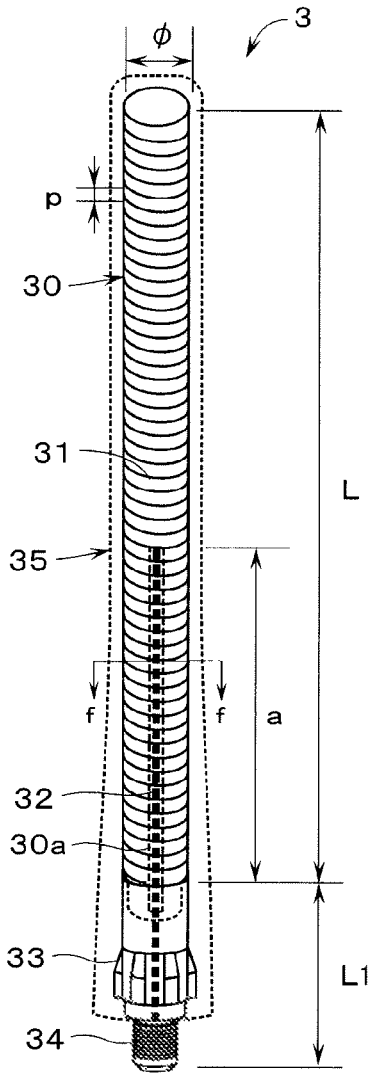
FIG. 12 is a perspective view showing the arrangement of the multi-frequency antenna of the third embodiment according to the present invention.
Figure 13:
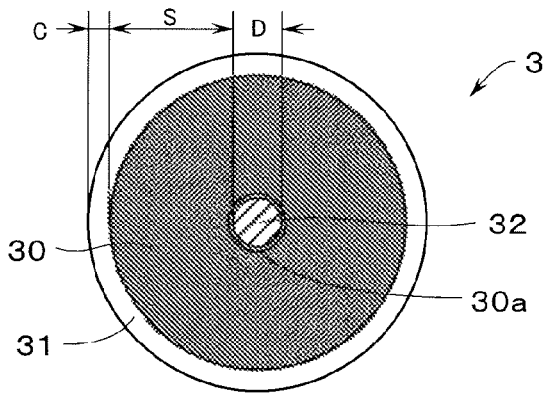
FIG. 13 is a sectional showing the arrangement of the multi-frequency antenna of the third embodiment according to the present invention view taken along the line f-f of FIG. 12.

Next, FIG. 11 is an exploded perspective view showing an arrangement of a multi-frequency antenna of a third embodiment according to the present invention, FIG. 12 is a perspective view showing the arrangement of the multi-frequency antenna of the third embodiment according to the present invention, and FIG. 13 is a sectional view showing the arrangement of the multi-frequency antenna of the third embodiment according to the present invention taken along the line f-f of FIG. 12.

The multi-frequency antenna 3 of the third embodiment according to the present invention shown in FIGS. 11 to 13 is a multi-frequency antenna arranged by embodying the multi-frequency antenna having the line-shaped elements 12' accommodated in the accommodation hole formed along approximately the central axis of the support member 10 shown in FIG. 8.

The multi-frequency antenna 3 of the third embodiment is composed of a rod-shaped insulation support member 30 which has an approximately circular cross section and a helical element 31 is wound around the outer periphery thereof at pitches p. A metal element fitting 33 is fitted with the lower end of the support member 30 and electrically connected to the lower end of the helical element 31. The lower portion of the element fitting 33 is arranged as an attachment portion 34 having a reduced diameter to fix the multi-frequency antenna 3 to an antenna case and the like, and a male screw is formed on the attachment portion 34 so that it is threaded into the an antenna case attached to, for example, a roof of a vehicle. The support member 30 is molded with resin and has flexibility, and a helical groove is formed around the outer periphery thereof. The helical element 31 having pitches p is formed by winding a conductor in the helical groove. Further, as shown by a broken line in FIG. 12, a portion from the extreme end of the support member 30, around which the helical element 31 is wound, to the element fitting 33, is molded with a resin antenna cover 35 so as to cover the helical element 31.

Further, an accommodation hole 30*a* having a predetermined length is formed from the lower end of the support member 30 upward approximately along the central axis thereof. A line-shaped element 32 having a length a slightly shorter than the length of the accommodation hole 30*a* is accommodated in the accommodation hole 30*a*. In this case, the line-shaped element 32 is inserted into an insertion hole formed in an attachment portion 34 located under the element fitting 33 from below the attachment portion 34 and the lower portion of the line-shaped element 32 is inserted into the insertion hole under pressure, thereby the line-shaped element 32 is electrically connected to the element fitting 33 as well as mechanically fixed thereto. The element fitting 33 in this state is positioned below the support member 30 around which the helical element 31 is wound, the line-shaped element 32 is inserted into the accommodation hole 30*a* formed in the support member 30, a connecting portion 31, which is formed at the lower portion of the support member 30 and has a slightly smaller diameter, is fitted with the element fitting 33 from above it, and the element fitting 33 of the portion is caulked. Since the helical element 31 is densely wound around the outer periphery of the connecting portion 31*a*, the lower end of the helical element 31 is electrically connected to the element fitting 33 so that power is supplied to the helical element 31 and the line-shaped element 32 from the element fitting 33.

The helical element 31 is made to have a length L, which allows the helical element 31 to resonate with the frequency band of FM broadcast, and the line-shaped element 32 is made to have a length, which allows the line-shaped element 32 to resonate with the frequency band of terrestrial digital television broadcast. In this case, the diameter $\phi$ of the helical element 31 wound around the support member 30 is set to about 6.81 mm, the pitches p thereof are set to about 1.76 mm, and the length L thereof is set to about 139 mm and the length a of the line-shaped element 32 is set to about 82 mm. Note that the length L1 of the element fitting 33 is set to about 22.5 mm. Although the length of the accommodation hole 30*a* is set to about 85 mm, it may be formed so as to pass through the overall support member 30. Further, the interval S between the helical element 31 and the line-shaped element 32 (refer to FIG. 13) is set to at least about 1 mm. In this case, when it is assumed that a wavelength of a 470 MHz to 710 MHz UHF band having a center frequency of 590 MHz as $\lambda$, 1 mm corresponds to about $0.0002\lambda$ in the frequency band of terrestrial digital television broadcast. Further, the diameter D of the line-shaped element 32 and the wire diameter C of the helical element 31 are set to about 1 mm (about $0.0002\lambda$) or less.

Figure 14:
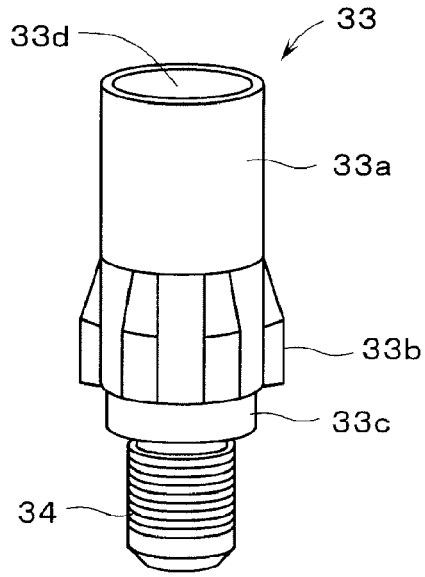
FIG. 14 is a perspective view showing an arrangement of an element fitting of the multi-frequency antenna of the third embodiment according to the present invention.
Figure 15:
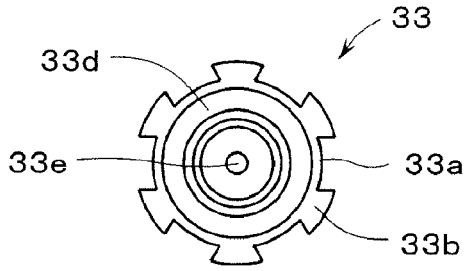
FIG. 15 is a plan view showing the arrangement of the element fitting of the multi-frequency antenna of the third embodiment according to the present invention.
Figure 16:
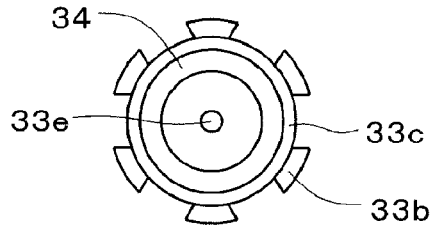
FIG. 16 is a bottom view showing the arrangement of the element fitting of the multi-frequency antenna of the third embodiment according to the present invention.
Figure 17:
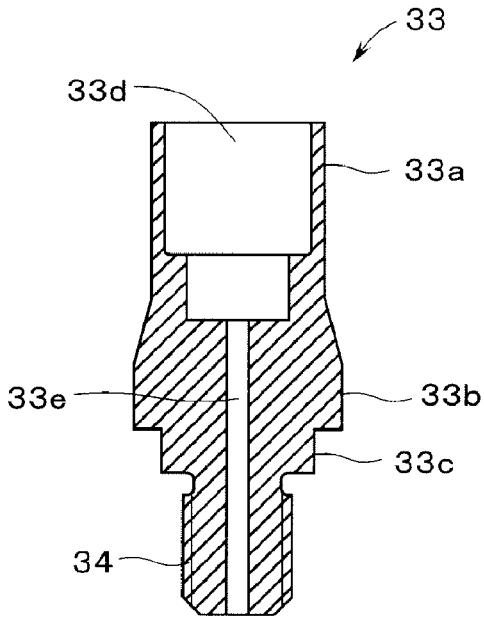
FIG. 17 is a sectional view showing the arrangement of the element fitting of the multi-frequency antenna of the third embodiment according to the present invention when the element fitting is cut along the central axis thereof.

FIG. 14 is a perspective view showing an arrangement of the element fitting 33, FIG. 15 is a plan view showing the arrangement of the element fitting 33, FIG. 16 is a bottom view showing the arrangement of the element fitting 33, and FIG. 17 is a sectional view showing the arrangement of the element fitting 33 taken along the central axis of the element fitting 33.

As shown in these drawings, the metal element fitting 33 is composed of a cylindrical portion 33*a* and the attachment portion 34 formed so as to project from the lower end of the cylindrical portion 33*a*. A plurality of (for example, six) projecting pieces 33*b* project from the outer periphery of the cylindrical portion 33*a* at the same interval in approximately the central portion of the element fitting 33. A lower cylindrical portion 33*c* is formed under the projecting pieces 33*b*, and the attachment portion 34, which has a thread formed around the outer periphery thereof, is formed under the lower cylindrical portion 33*c*. An insertion hole 33*d* is formed in the upper portion in the inside of the cylindrical portion 33*a* so that a connecting portion 31*a* formed in the lower portion of the support member 30 is inserted thereto and fitted, the diameter of the lower portion of the insertion hole 33*d* is slightly reduced, and an insertion hole 33*e*, which communicates with the insertion hole 33*d* and has a thin diameter, is formed passing through the attachment portion 34. The insertion hole 33*e* is formed approximately on the longer axis of the element fitting 33, and the line-shaped element 32 is inserted into the insertion hole 33*e*. Note that the widths of the plurality of projecting pieces 33*b* are increased toward the extreme ends thereof so that when the antenna cover 35 is molded, it can be securely molded to the element fitting 33.

Figure 18A:
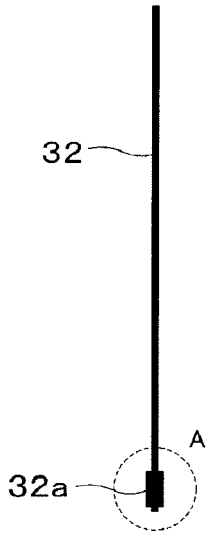
FIG. 18(*a*) is a front elevational view of a line-shaped element of the multi-frequency antenna of the third embodiment according to the present invention.
Figure 18B:
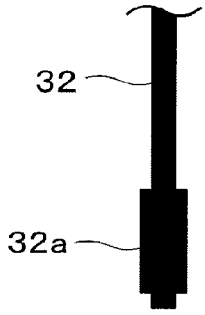

FIG. 18(*a*) is a front elevational view showing an arrangement of the line-shaped element 32, and FIG. 18(*b*) is a partially enlarged view of the line-shaped element 32.

As shown in these drawings, the line-shaped element 32 is composed of a line-shaped metallic wire and has a flatly-pressed portion 32*a* pressed flat in the lower portion thereof. The line-shaped element 32 is inserted into the insertion hole 33*e* from below the attachment portion 34 of the element fitting 33. When the flatly-pressed portion 32*a* is abutted against the lower end of the insertion hole 33*e*, the flatly-pressed portion 32*a* is inserted into the insertion hole 33*e* under pressure using a tool. With this operation, the line-shaped element 32 is fixed to the element fitting 33 as well as electrically connected thereto.

Figure 19:
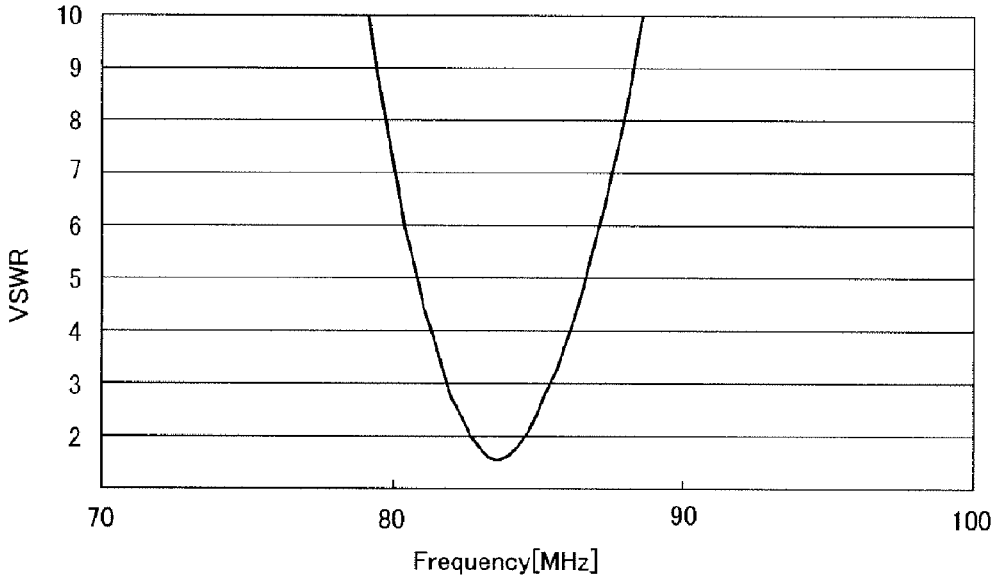
FIG. 19 is a view showing the frequency characteristics of a voltage standing wave ratio (VSWR) in the frequency band of FM broadcast of the multi-frequency antenna of the third embodiment according to the present invention.

In the multi-frequency antenna 3 of the third embodiment according to the present invention, the winding diameter $\phi$ of the helical element 31 is set to about 6.8 mm, the wire diameter C thereof is set to about 0.4 mm, the pitches p thereof are set to about 1.76 mm, and the length L thereof is set to about 139 mm, the length a of the line-shaped element 32 is set to about 82 mm and the diameter D thereof is set to about 0.8 mm, and the interval S between the helical element 31 and the line-shaped element 32 is set to about 2.6 mm. FIG. 19 shows the frequency characteristics of a VSWR of the frequency band of FM broadcast, and FIG. 20 shows the frequency characteristics of a VSWR of the frequency band of terrestrial digital television broadcast when the multi-frequency antenna 3 having the helical element 31 and the line-shaped element 32 each of which is set to the above dimensions is attached to an antenna case.

Figure 20:
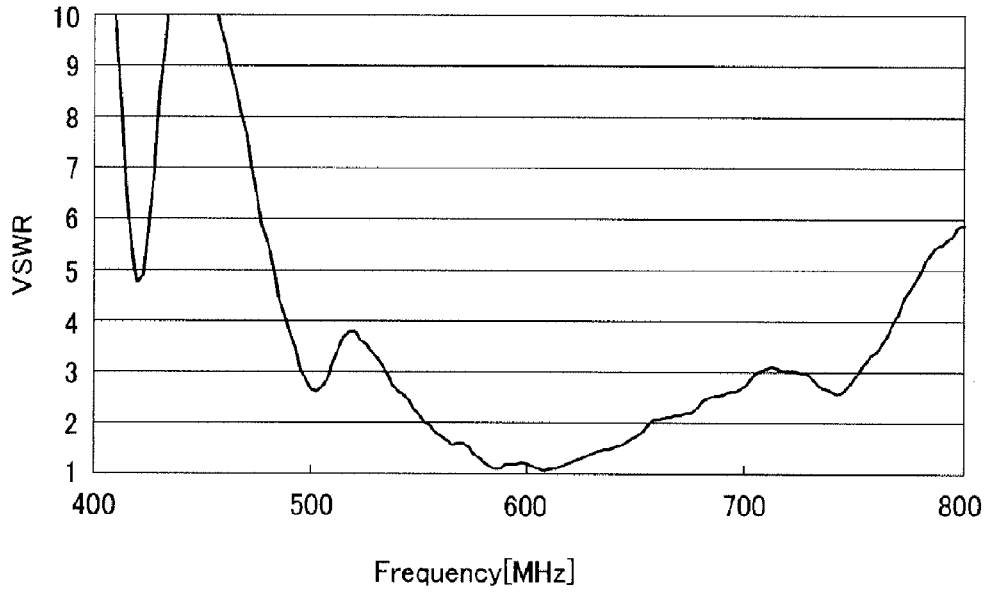
FIG. 20 is a view showing the frequency characteristics of a VSWR in the frequency band of terrestrial digital television broadcast of the multi-frequency antenna of the third embodiment according to the present invention.

Referring to FIGS. 19 and 20, the multi-frequency antenna 3 of the third embodiment having the above dimensions has a resonant frequency in the vicinity of about 83 MHz and can be sufficiently operated in the frequency band of FM broadcast as well as approximately operated in the 470 MHz to 710 MHz frequency band of terrestrial digital television broadcast.

Further, in the prior antenna device 100 shown in FIG. 29 and having the helical element, when the pitches P of the helical element are set to about 1.48 mm and the length L thereof is set to 154 mm, the prior antenna device 100 approximately resonates with 83 MHz which is the center frequency of FM broadcast. In contrast, the multi-frequency antenna 3 according to the present invention approximately resonates with 83 MHz, which is the center frequency of FM broadcast, even with the length L is shortened to 139 mm regardless that the pitches p are increased to about 1.76 mm. As described above referring to FIG. 5, it is considered that this is because the electric length of the helical element 31 is equivalently increased with the effect of the line-shaped element 32.

As described above, the multi-frequency antenna 3 of the third embodiment according to the present invention can be low-profiled even being allowed to operate in a plurality of frequency bands because the helical element 31 with the effect of the line-shaped element 32. Further, when the helical element 31 is used as a voltage receiving device in the frequency band of AM broadcast, the helical element 31 can be also used as an antenna for receiving AM broadcast. With this arrangement, the multi-frequency antenna 3 of the third embodiment according to the present invention can be arranged as a multi-frequency antenna capable of receiving AM/FM broadcast and terrestrial digital television broadcast.

Here, since the arrangement of a receiving system when the multi-frequency antenna 3 of the third embodiment according to the present invention is mounted on a vehicle and the like is the same as the arrangement shown in the block diagram shown in FIG. 6, the explanation thereof is omitted.

Figure 21:
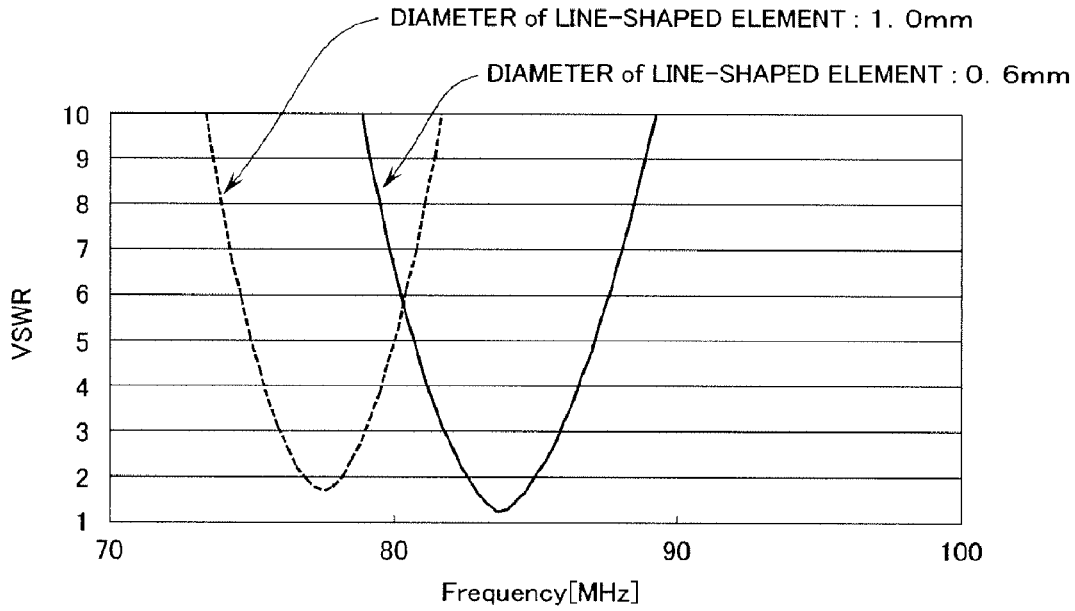
FIG. 21 is a view showing the frequency characteristics of a VSWR of the frequency band of FM broadcast when the diameter of the line-shaped element is increased in the multi-frequency antenna of the third embodiment according to the present invention in comparison with the frequency characteristics of the VSWR when the line-shaped element has a small diameter.

Next, FIG. 21 shows the frequency characteristics of a voltage standing wave ratio (VSWR) of the frequency band of FM broadcast when the diameter D of the line-shaped element 32 is increased to about 1 mm in the multi-frequency antenna 3 of the third embodiment according to the present invention in comparison with the frequency characteristics of a VSWR when the diameter D of the line-shaped element 32 is reduced to about 0.6 mm. Note that the other dimensions of the multi-frequency antenna 3 are set to the dimensions when the electric characteristics shown in FIGS. 19 and 20 are obtained.

Referring to FIG. 21, it can be seen that when the diameter D of the line-shaped element 32 is increased to about 1 mm, the resonant frequency in the frequency band of FM broadcast is made to about 78 MHz, and thus the resonant frequency shifts to a lower region. As described above, in the multi-frequency antenna 3 of the third embodiment, the larger the diameter D of the line-shaped element 32 becomes the more it affects the helical element 31, and thus the resonant frequency shifts to lower region. Therefore, the thickness of the line-shaped element 32 cannot be so much increased.

Figure 22:
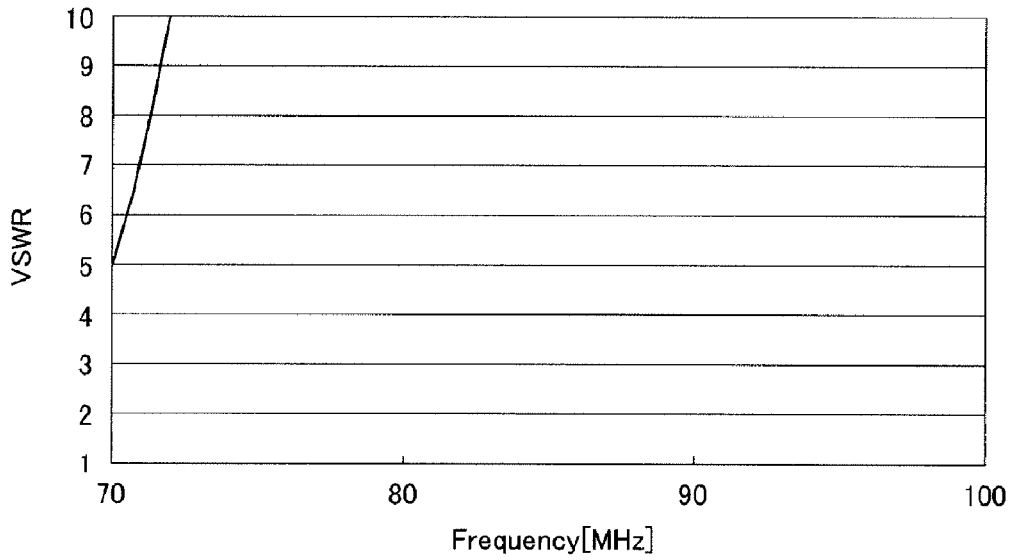
FIG. 22 is a view showing the frequency characteristics of a VSWR of the frequency band of FM broadcast when the interval between a helical element and the line-shaped element is reduced in the multi-frequency antenna of the third embodiment according to the present invention.

Further, FIG. 22 shows the frequency characteristics of a VSWR of the frequency band of FM broadcast when the multi-frequency antenna 3, in which the interval S between the helical element 31 and the line-shaped element 32 is narrowed to about 1 mm, is attached to the antenna case in the multi-frequency antenna 3 of the third embodiment according to the present invention. Note that the other dimensions of the multi-frequency antenna 3 are set to the dimensions when the electric characteristics shown in FIGS. 19 and 20 are obtained.

Referring to FIG. 22, it can be seen that when the interval S between the helical element 31 and the line-shaped element 32 is narrowed to about 1 mm, the resonant frequency shifts to the excessively lower region and no resonant frequency appears in the frequency band of 70 MHz to 100 MHz, which means that the multi-frequency antenna 3 is hardly operated in the frequency band of FM broadcast. As described above, in the multi-frequency antenna 3 of the third embodiment, the narrower the interval S between the helical element 31 and the line-shaped element 32 becomes, the more the helical element 31 is affected, and thus the resonant frequency shifts to lower region. Therefore, the interval S between the helical element 31 and the line-shaped element 32 cannot be so much narrowed.

Figure 23:
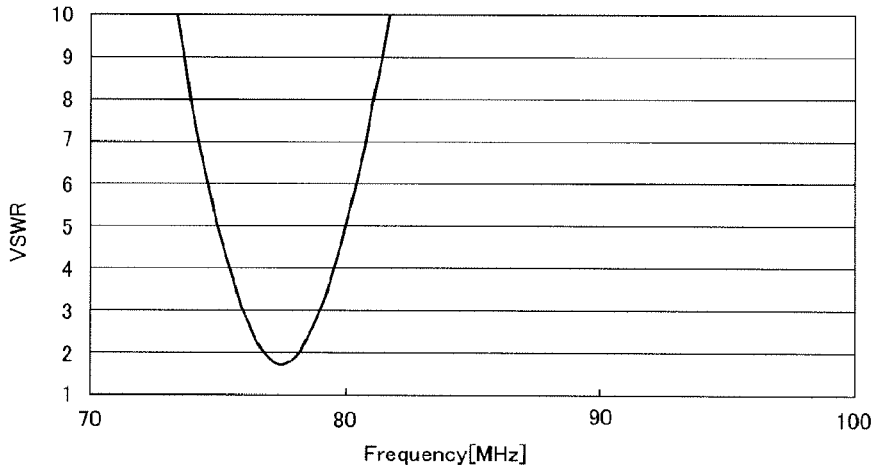
FIG. 23 is a view showing the frequency characteristics of the VSWR of the frequency band of FM broadcast when the diameter of the line-shaped element is increased as well as the interval between the helical element and the line-shaped element is increased in the multi-frequency antenna of the third embodiment according to the present invention.
Figure 24:
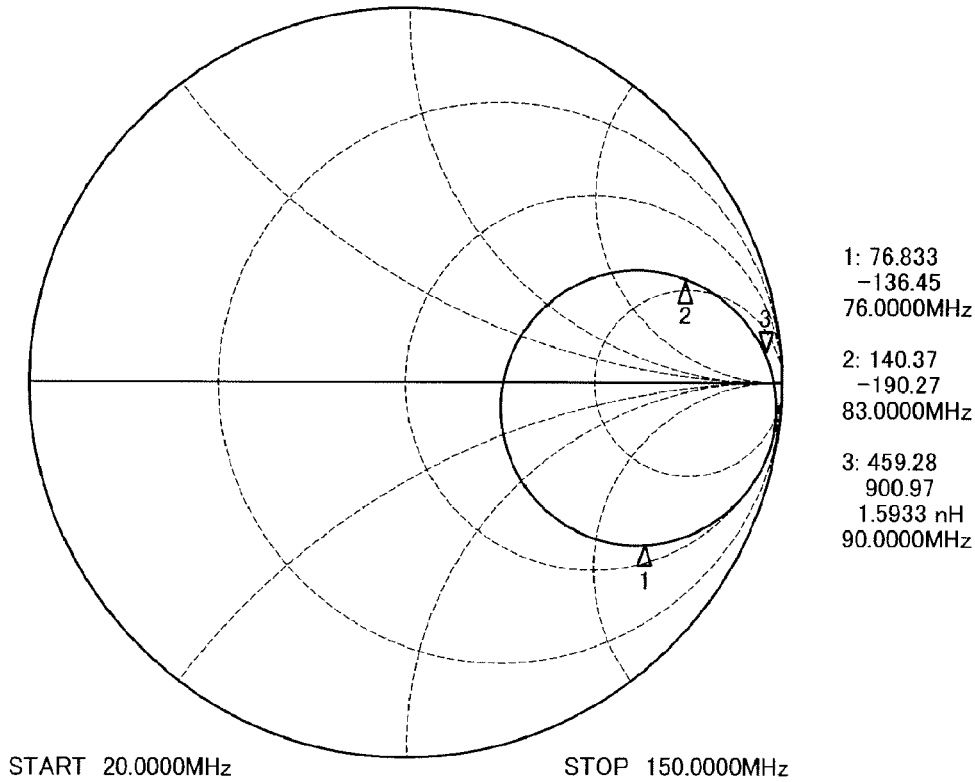
FIG. 24 is a Smith chart showing the frequency characteristics of impedance in the frequency band of FM broadcast when the diameter of the line-shaped element is increased as well as the interval between the helical element and the line-shaped element is increased in the multi-frequency antenna of the third embodiment according to the present invention.

Further, FIG. 23 shows the frequency characteristics of a VSWR of the frequency band of FM broadcast and FIG. 24 shows a Smith chart showing the frequency characteristics of impedance in the frequency band of FM broadcast when the multi-frequency antenna 3 of the third embodiment according to the present invention, in which the diameter D of the line-shaped element 32 is set to about 1 mm as well as the interval S between the helical element 31 and the line-shaped element 32 is set to about 1.5 mm, is attached to the antenna case. Note that the other dimensions of the multi-frequency antenna 3 are set to the dimensions when the electric characteristics shown in FIGS. 19 and 20 are obtained.

Referring to FIGS. 23 and 24, it can be seen that the resonant frequency shifts from 70 MHz or less to about 78 MHz by increasing the interval S between the helical element 31 and the line-shaped element 32 from about 1 mm to about 1.5 mm even with the diameter D of the line-shaped element 32 increased to about 1 mm. As described above, in the multi-frequency antenna 3 of the third embodiment, even if the diameter of the line-shaped element 32 is increased, the helical element 31 is less affected by increasing the interval S between the helical element 31 and the line-shaped element 32, thereby the resonant frequency shifts to a higher region. In this case, when the pitches P are slightly coarsened to about 1.89 mm without changing the length L of the helical element 31, the electric length of the helical element 31 is shortened, thereby the multi-frequency antenna 3 can be approximately resonates with 83 MHz which is the center frequency of FM broadcast. Note that, the multi-frequency antenna 3 can be sufficiently operated in the frequency band of FM broadcast although VSWR characteristics are somewhat deteriorated.

Further, even if the interval S between the helical element 31 and the line-shaped element 32 is narrowed, the multi-frequency antenna 3 can approximately resonate with 83 MHz which is the center frequency of FM broadcast by reducing the diameter D of the line-shaped element. As described above, in the multi-frequency antenna 3 of the third embodiment according to the present invention, desired electric characteristics can be obtained by combining the diameter D of the line-shaped element and the interval S between the helical element 31 and the line-shaped element 32 and adjusting the electric length of the helical element 31.

It is preferable from what has been described above to set the diameter D of the line-shaped element 32 to about 1 mm or less and to set the interval S between the helical element 31 and the line-shaped element 32 to about 1 mm or more in the multi-frequency antenna 3 of the third embodiment according to the present invention. Further, since desired electric characteristics can be obtained in the frequency bands of FM broadcast and terrestrial digital television broadcast by reducing the wire diameter C of the helical element 31, the wire diameter C of the helical element 31 is preferably set to about 1 mm or less.

Figure 25:
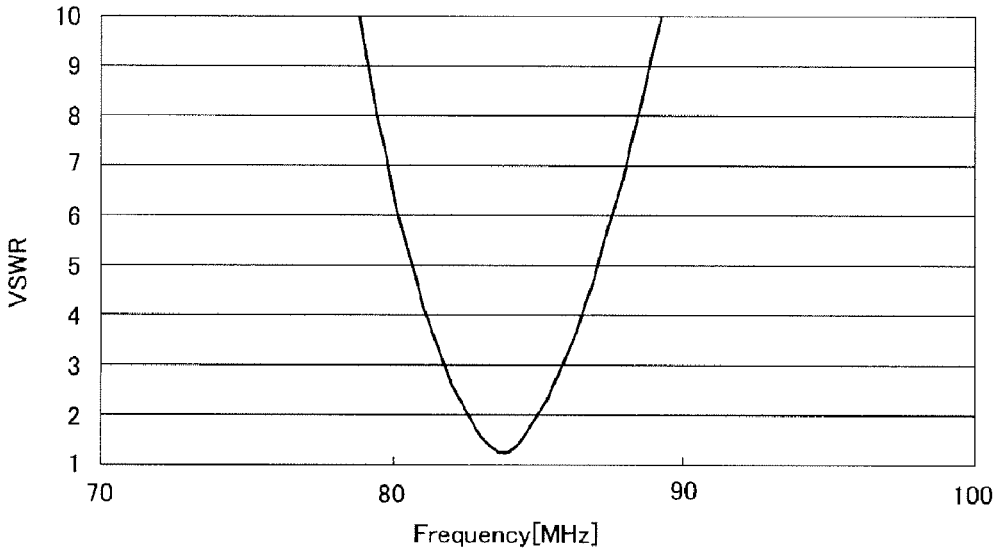
FIG. 25 is a view showing the frequency characteristics of the VSWR of the frequency band of FM broadcast when the length of the helical element is increased and the length of the line-shaped element is slightly reduced in the multi-frequency antenna of the third embodiment according to the present invention.
Figure 26:
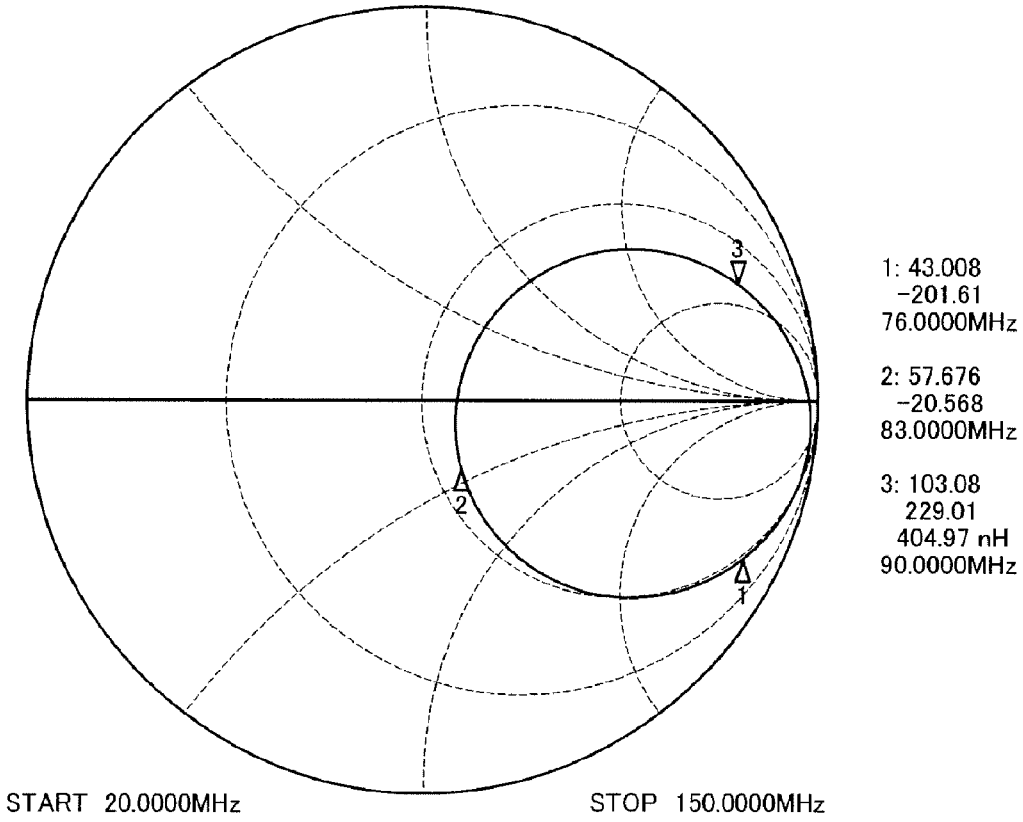
FIG. 26 is a Smith chart showing the frequency characteristics of the impedance of the frequency band of FM broadcast when the length of the helical element is increased and the length of the line-shaped element is slightly reduced in the multi-frequency antenna of the third embodiment according to the present invention.

Next, FIGS. 25 and 26 show the electric characteristics in the frequency band of FM broadcast and the frequency band of terrestrial digital television broadcast when the multi-frequency antenna 3 of the third embodiment, in which the length L of the helical element 31 is increased to about 152 mm and the length a of the line-shaped element 32 is slightly reduced to about 78 mm, is attached to the antenna case. Note that other dimensions of the multi-frequency antenna 3 are set to the dimensions when the electric characteristics shown in FIGS. 19 and 20 are obtained.

FIG. 25 shows the electric characteristics which are the frequency characteristics of a VSWR in the frequency band of FM broadcast of the multi-frequency antenna 3 of the third embodiment, and FIG. 26 is a Smith chart showing the electric characteristics which are the frequency characteristics of impedance in the frequency band of FM broadcast. Referring to FIGS. 25 and 26, it can be seen that the multi-frequency antenna 3 of the third embodiment approximately resonates with 83 MHz which is the center frequency of FM broadcast as well as the VSWR characteristics are made broader than the VSWR characteristics shown in FIG. 19, which means that the multi-frequency antenna 3 is sufficiently operated in the frequency band of FM broadcast because.

Figure 27:
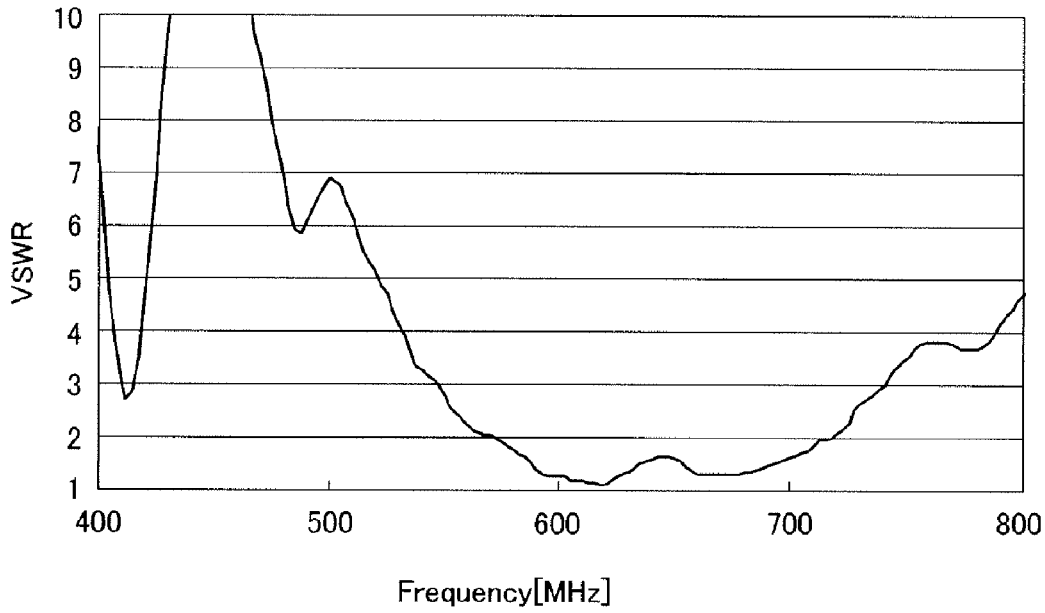
FIG. 27 is a view showing the frequency characteristics of the VSWR in the frequency band of the terrestrial digital television of the multi-frequency antenna as a single body when the length of the helical element is increased and the length of the line-shaped element is slightly reduced in the multi-frequency antenna of the third embodiment according to the present invention.
Figure 28:
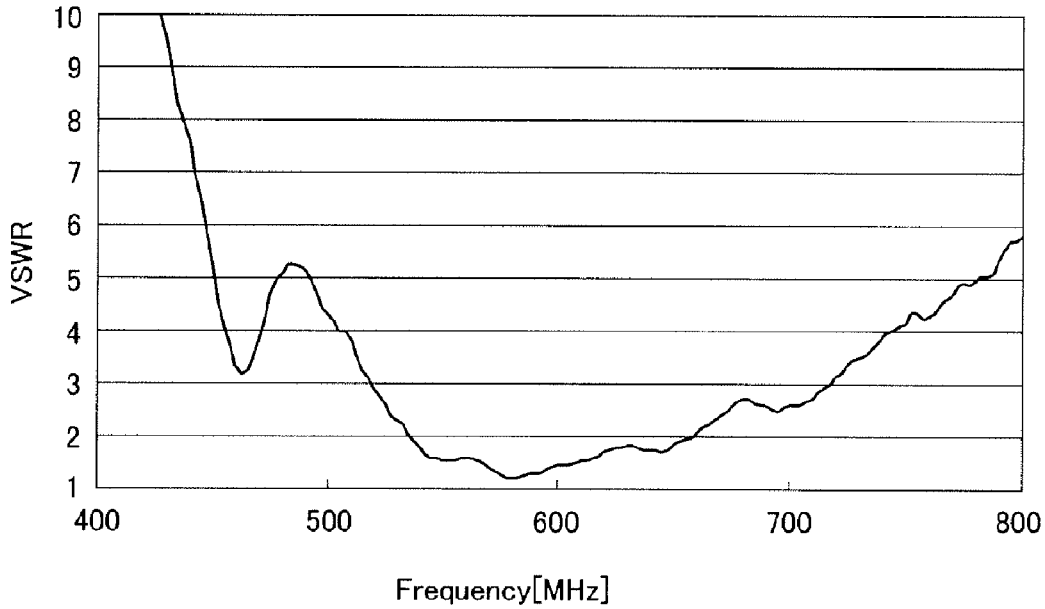
FIG. 28 is a view showing the frequency characteristics of the VSWR of the frequency band of the terrestrial digital television broadcast when the length of the helical element is increased and the length of the line-shaped element is slightly reduced in the multi-frequency antenna of the third embodiment according to the present invention.

Further, FIG. 27 shows the electric characteristics which are the frequency characteristics of a VSWR in the frequency band of terrestrial digital television broadcast as a single body when the multi-frequency antenna 3 having the above dimensions of the third embodiment according to the present invention is not attached to the antenna case, and FIG. 28 shows the electric characteristics which are the frequency characteristics of a VSWR in the frequency band of terrestrial digital television broadcast when the multi-frequency antenna 3 having the above dimensions of the third embodiment according to the present invention is attached to the antenna case. Referring to FIG. 27, although the frequency characteristics are made to the broad frequency characteristics in which the multi-frequency antenna 3 resonates with the vicinity of 610 MHz, the frequency characteristics are offset to higher region from the frequency band of terrestrial digital television broadcast when it is provided as a single body. However, referring to FIG. 28, it can be seen that the frequency characteristics are made to broad frequency characteristics in which the multi-frequency antenna 3 of the third embodiment resonates with the vicinity of 590 MHz which is the center frequency of terrestrial digital television broadcasts and which means that the multi-frequency antenna 3 is approximately operated in the 470 MHz to 710 MHz frequency band of terrestrial digital television broadcast. It is considered that when the multi-frequency antenna 3 is attached to the antenna case as described above, the frequency characteristics of a VSWR of the multi-frequency antenna 3 shift to lower region in their entirety with the effect of wirings in the antenna case. Note that since the wavelength of FM broadcast is much longer than the wirings in the antenna case, the electric characteristics are hardly changed depending on whether the antenna case is present or not.

As described above, in the multi-frequency antenna 3 of the third embodiment, even if the length a of the line-shaped element 32 is slightly reduced and the length L of the helical element 31 is increased, the multi-frequency antenna 3 is sufficiently operated in the frequency band of FM broadcast and the frequency band of terrestrial digital television broadcast. In this case, when the helical element 31 is used as a voltage receiving device in the frequency band of AM broadcast, the multi-frequency antenna 3 can be also used as a multi-frequency antenna capable of receiving AM/FM broadcast and terrestrial digital television broadcast.

In the multi-frequency antenna 3 of the third embodiment according to the present invention described above, the typical value of the diameter D of the line-shaped element 32 is set to about 0.8 mm, and the line-shaped element 32 having the dimension is accommodated in the accommodation hole 30*a*. Therefore, since the diameter of the accommodation hole 30*a* can be reduced (to about 1 mm), even if the support member 30 is formed in the pipe shape, it can be made flexible sufficiently, thereby even if bending stress is applied to support member 30, it is flexed without being broken. Further, when the interval S between the helical element 31 and the line-shaped element 32 is set to about 2.6 mm or less, the diameter of the support member 30 is reduced and thus the diameter of the multi-frequency antenna 3 is reduced. With this arrangement, the multi-frequency antenna 3 has flexibility.

INDUSTRIAL APPLICABILITY

It is preferable to set the interval between the helical element and the line-shaped element to at least about 1 mm to obtain the electric characteristics described above in the multi-frequency antenna devices of the first and second embodiments according to the present invention described above. Thus, when the line-shaped element is covered with an insulation tube having a thickness of about 1 mm or more and disposed in the taper-shaped groove formed on the support member, the outer periphery of the insulation tube can be caused to come into contact with the taper-shaped groove as well as to come into contact with the helical element, thereby the interval between the line-shaped element and the helical element can be set to a predetermined interval. With this arrangement, the electric characteristics of the multi-frequency antenna can be stabilized. Further, an insulation material having a low dielectric constant may be interposed between the helical element and the line-shaped element so that the interval between the helical element and the line-shaped element is set to a predetermined interval.

Note that although the four groove portions are formed on the outer periphery of the support member at the same interval in the multi-frequency antenna devices of the first and the second embodiments according to the present invention described above, the present invention is not limited thereto and the grooves may be formed as many as the line-shaped elements. In this case, when a plurality of groove portions are formed, it is preferable to form them at the same interval. Further, although the multi-frequency antenna according to the present invention is arranged so as to be attached to a roof and a trunk of a vehicle, the present invention is not limited thereto and can be applied to a multi-frequency antenna as long as it is operated in two or more frequency bands.

The invention claimed is:

1. A multi-frequency antenna comprising:

an insulation support member formed in a rod shape, the support member having a first end, a central axis, an outer periphery, and a plurality of groove portions, each groove portion having a predetermined length formed on the outer periphery of the support member, the plurality of groove portions extending from the first end of the support member and substantially parallel to the central axis of the support member, the plurality of groove portions being formed at equal circular intervals with each other;

a helical element wound around the outer periphery of the support member, the helical element being configured to have power supplied from a first end of the helical element and the helical element being operable in a first frequency band;

a plurality of line-shaped elements, each of the plurality of line-shaped elements being disposed in respective groove portion of the plurality of groove portions formed in the support member, each of the plurality of line-shaped elements being configured to have power supplied from a first end of each of the plurality of line-shaped elements and each of the plurality of the line-shaped elements being operable in a frequency band that is different from the first frequency band; and an element fitting fitted with the first end of the support member, electrically connected to the first end of the helical element and to the first end of each of the plurality of line-shaped elements, and having an attachment portion formed in a lower portion of the element fitting, wherein the element fitting is configured to supply power to the helical element and the plurality of line-shaped elements, the only portion of each of the plurality of the line-shaped elements that electrically connects to the helical element is the first end of each of the plurality of the line-shaped elements, and at least one of the plurality of groove portions has no line-shaped element disposed therein.

2. The multi-frequency antenna according to claim 1, wherein the support member is formed of flexible resin, the multi-frequency antenna further comprising:

a helical groove, around which the helical element is wound, the helical groove being formed around the outer periphery of the support member.

3. The multi-frequency antenna according to claim 1, wherein the plurality of line-shaped elements are configured to operate in different frequency bands from each other.

4. The multi-frequency antenna according to claim 1, wherein the line-shaped element is configured to be disposed in the groove portion by being separated from the helical element at a predetermined level.

5. The multi-frequency antenna according to claim 2, wherein the line-shaped element is configured to be disposed in the groove portion by being separated from the helical element at a predetermined interval.

6. The multi-frequency antenna according to claim 3, wherein the line-shaped element is configured to be disposed in the groove portion by being separated from the helical element at a predetermined interval.

7. The multi-frequency antenna according to claim 1, further comprising:

an insulation tube with a predetermined thickness configured to cover the line-shaped element, which is configured to be disposed in the groove portion by being separated from the helical element at a predetermined interval.

8. The multi-frequency antenna according to claim 2, further comprising:

an insulation tube with a predetermined thickness configured to cover the line-shaped element, which is configured to be disposed in the groove portion by being separated from the helical element at a predetermined interval.

9. The multi-frequency antenna according to claim 3, further comprising:

an insulation tube with a predetermined thickness configured to cover the line-shaped element, which is configured to be disposed in the groove portion by being separated from the helical element at a predetermined interval.

10. The multi-frequency antenna according to claim 1, wherein the helical element has a pitch of about 1.76 mm and a length of about 139 mm.

* * * * *